US011462825B2

(12) United States Patent
Shailendra et al.

(10) Patent No.: US 11,462,825 B2
(45) Date of Patent: Oct. 4, 2022

(54) ANTENNA

(71) Applicant: Fujikura Ltd., Tokyo (JP)

(72) Inventors: Kaushal Shailendra, Sakura (JP); Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 73 days.

(21) Appl. No.: 17/051,214

(22) PCT Filed: Mar. 25, 2019

(86) PCT No.: PCT/JP2019/012547
§ 371 (c)(1),
(2) Date: Oct. 28, 2020

(87) PCT Pub. No.: WO2019/225141
PCT Pub. Date: Nov. 28, 2019

(65) Prior Publication Data

US 2021/0066796 A1 Mar. 4, 2021

(30) Foreign Application Priority Data

May 25, 2018 (JP) ..... JP2018-100307

(51) Int. Cl.
*H01Q 3/01* (2006.01)
*H01Q 1/22* (2006.01)
(Continued)

(52) U.S. Cl.
CPC ..... *H01Q 3/01* (2013.01); *H01Q 1/2283* (2013.01); *H01Q 1/38* (2013.01); *H01Q 1/48* (2013.01)

(58) Field of Classification Search
CPC ..... H01Q 1/2283; H01Q 1/38; H01Q 1/48; H01Q 21/0075; H01Q 21/065; H01Q 3/01; H01Q 23/00
See application file for complete search history.

(56) References Cited

U.S. PATENT DOCUMENTS 6,285,337 B1 9/2001 West et al.
2012/0026054 A1 2/2012 Liu et al.
(Continued)

FOREIGN PATENT DOCUMENTS

EP 0614246 A1 9/1994
JP 3-283903 A 12/1991
(Continued)

OTHER PUBLICATIONS

International Search Report dated Jun. 4, 2019, issued in counterpart application No. PCT/JP2019/012547, w/English translation (3 pages).
(Continued)

*Primary Examiner* — Ricardo I Magallanes
(74) *Attorney, Agent, or Firm* — WHDA, LLP

(57) ABSTRACT

To widen a range of an angle in which the directivity of an antenna is controllable to be high. An antenna includes a sheet-shaped laminated body that includes a conductive pattern layer, a first dielectric layer, a conductive ground layer, and an antenna pattern layer, the antenna pattern layer including element rows arranged in parallel, the element rows each including even-numbered radiation elements that are connected in series and linearly aligned at an interval in a direction orthogonal to a parallel alignment direction of the element rows, the conductive pattern layer including feed lines for feeding power to the center of each or the element rows, the element rows being divided into groups using a bending line as a boundary, by bending the laminated body along the bending line.

12 Claims, 22 Drawing Sheets

(51) Int. Cl.
*H01Q 1/38* (2006.01)
*H01Q 1/48* (2006.01)

(56) References Cited

U.S. PATENT DOCUMENTS

| | | | | |
|---|---|---|---|---|
| 2012/0235874 | A1* | 9/2012 | Kwak | H01Q 1/288<br>343/837 |
| 2014/0306846 | A1* | 10/2014 | Nakatsu | H01Q 21/29<br>343/700 MS |
| 2015/0255867 | A1* | 9/2015 | Inoue | H01Q 21/065<br>343/853 |
| 2016/0226154 | A1* | 8/2016 | Chang | H01Q 21/20 |

FOREIGN PATENT DOCUMENTS

| | | | |
|---|---|---|---|
| JP | 3440298 | B2 | 8/2003 |
| JP | 2010-212946 | A | 9/2010 |
| JP | 2014-212361 | A | 11/2014 |

OTHER PUBLICATIONS

Written Opinion dated Jun. 4, 2019, issued in counterpart application No. PCT/JP2019/012547 (3 pages).
Notice of Reasons for Refusal dated Oct. 1, 2019, issued in counterpart Japanese Patent Application No. 2018-100307, w/English translation (8 pages).

* cited by examiner

ANTENNA

TECHNICAL FIELD

The present disclosure relates to an antenna.

BACKGROUND ART

Patent Literature 1 discloses a technique for controlling the directivity of an array antenna in which a plurality of array elements are arranged in parallel. In general, when signals of array elements have the same phase, the directivity in the vertical direction of an array antenna is high, and when a phase difference occurs between the signals of the array elements, the directivity in a direction oblique to the vertical direction is high. Accordingly, the directivity of the array antenna is controllable by controlling the phase difference between the signals of the array elements.

CITATION LIST

Patent Literature

Patent Literature 1: Japanese Patent No. 3440298

SUMMARY OF INVENTION

Technical Problem

Incidentally, it is desired to widen a range of an angle in which the directivity of the antenna is controllable to be high.

Thus, the present disclosure has been achieved in view of such circumstances as described above, and an object of the present disclosure is to widen a range of an angle in which the directivity of an antenna is controllable to be high.

Solution to Problem

A primary aspect of the present disclosure to achieve an object described above is an antenna comprising: a laminated body having a sheet shape, the laminated body including a first dielectric layer that is flexible, a conductive pattern layer formed on a surface of the first dielectric layer, a second dielectric layer that is flexible, the second dielectric layer being bonded to the first dielectric layer on a side opposite to the conductive pattern layer with respect to the first dielectric layer, a conductive ground layer formed between the first dielectric layer and the second dielectric layer, and an antenna pattern layer formed on the second dielectric layer on a side opposite to the conductive ground layer with respect to the second dielectric layer, the antenna pattern layer including a plurality of element rows arranged in parallel, the element rows each including even-numbered radiation elements that are linearly aligned at an interval in a direction orthogonal to a direction in which the element rows arranged in parallel, the even-numbered radiation elements being connected in series, the conductive pattern layer including a plurality of feed lines each for feeding power to the center of each of the element rows, the laminated body being bended along a bending line parallel to an alignment direction of the even-numbered radiation elements, thereby dividing the element rows into a plurality of groups using the bending line as a boundary.

Other features of the present disclosure will become apparent by the following description and the drawings.

Advantageous Effects of Invention

According to embodiments of the present disclosure, it is possible to widen a range of an angle in which the directivity of an antenna is controllable to be high.

DESCRIPTION OF EMBODIMENTS

Figure 1:
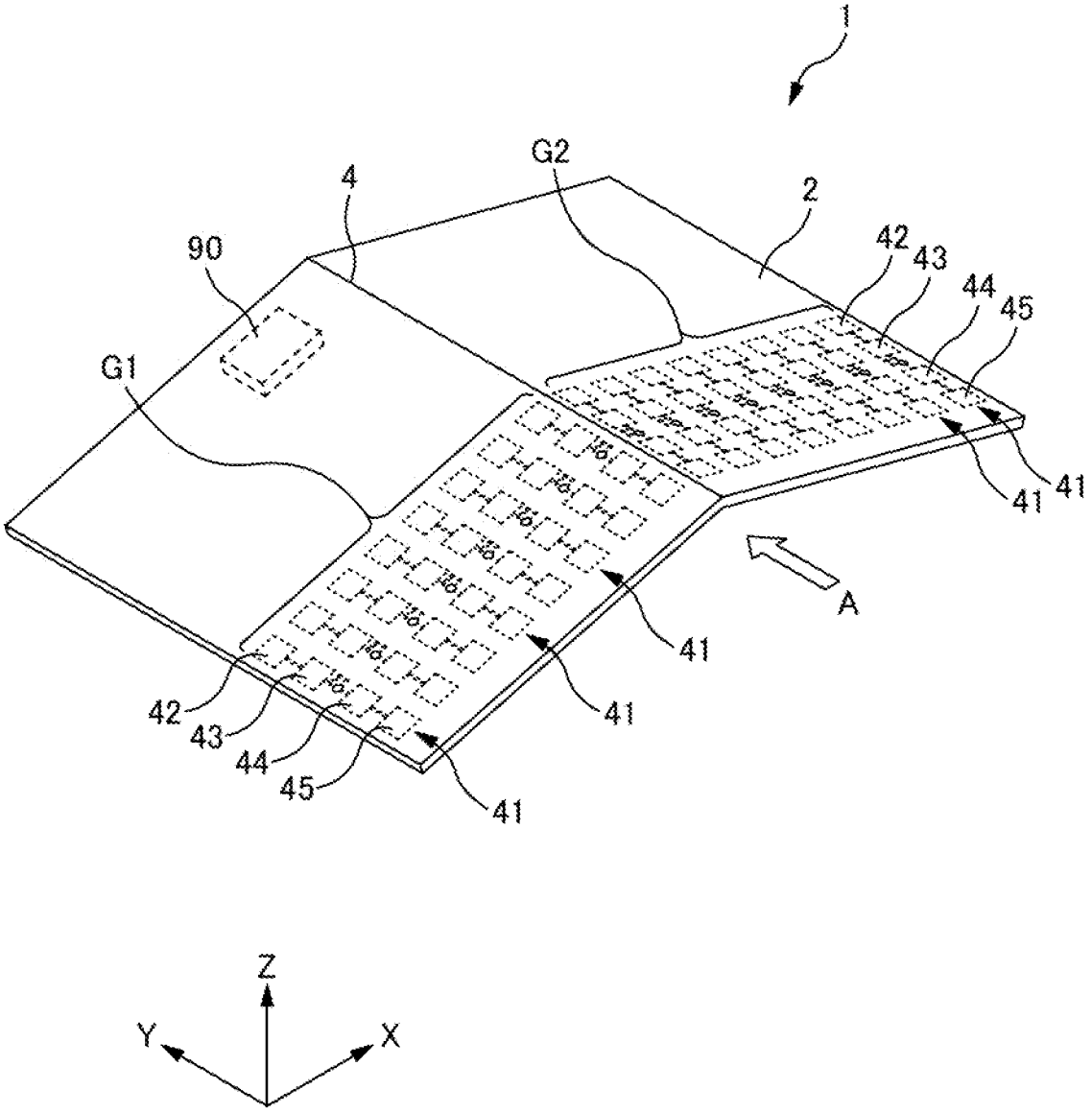
FIG. 1 is a perspective view of an antenna according to a first embodiment.

At least the following matters will become apparent from the following description and the drawings.

An antenna will be made apparent which comprises: antenna comprising: a laminated body having a sheet shape, the laminated body including a first dielectric layer that is flexible, a conductive pattern layer formed on a surface of the first dielectric layer, a second dielectric layer that is flexible, the second dielectric layer being bonded to the first dielectric layer on a side opposite to the conductive pattern layer with respect to the first dielectric layer, a conductive ground layer formed between the first dielectric layer and the second dielectric layer, and an antenna pattern layer formed on the second dielectric layer on a side opposite to the conductive ground layer with respect to the second dielectric layer, the antenna pattern layer including a plurality of element rows arranged in parallel, the element rows each including even-numbered radiation elements that are linearly aligned at an interval in a direction orthogonal to a direction in which the element rows arranged in parallel, the even-numbered radiation elements being connected in series, the conductive pattern layer including a plurality of feed lines each for feeding power to the center of each of the element rows, the element rows being divided into a plurality of groups using a bending line as a boundary, by bending the laminated body along the bending line parallel to an alignment direction of the even-numbered radiation elements.

According to the above, a range in which directivity of the antenna is controllable to be high is widened by controlling a phase of a signal wave of each of the feed lines.

The laminated body is bent so as to be mountain-folded along the bending line with the antenna pattern layer facing outward. Alternatively, the laminated body is bent so as to be valley-folded along the bending line with the antenna pattern layer facing inward. Preferably, the bending line includes one bending line, the number of the element rows is an even number, and the element rows are equally divided into two groups using the bending line as a boundary.

The bending line includes two bending lines, the element rows are divided into three groups using the bending lines as boundaries, and groups on both sides among the three groups have an equal number of the element rows. Preferably, a bending angle of the laminated body at one of the bending lines is equal to a bending angle of the laminated body at another one of the bending lines.

An RFIC is mounted on a portion of the laminated body between the two bending lines.

EMBODIMENTS

Embodiments of the present disclosure will be described below with reference to the drawings. Note that, although various limitations that are technically preferable for carrying out the present disclosure are imposed on the embodiments described below, the scope of the disclosure is not to be limited to the embodiments below and illustrated examples.

First Embodiment

Figure 2:
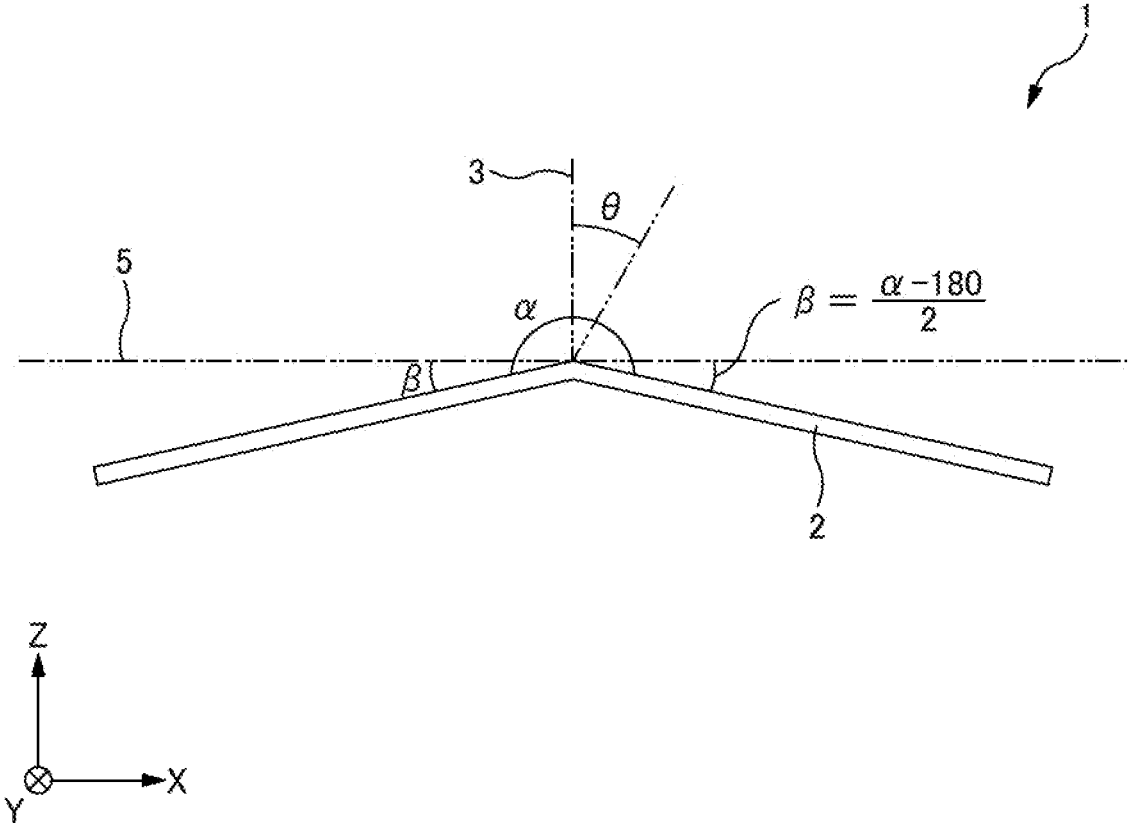
FIG. 2 is a front view of an antenna according to a first embodiment.
Figure 3:
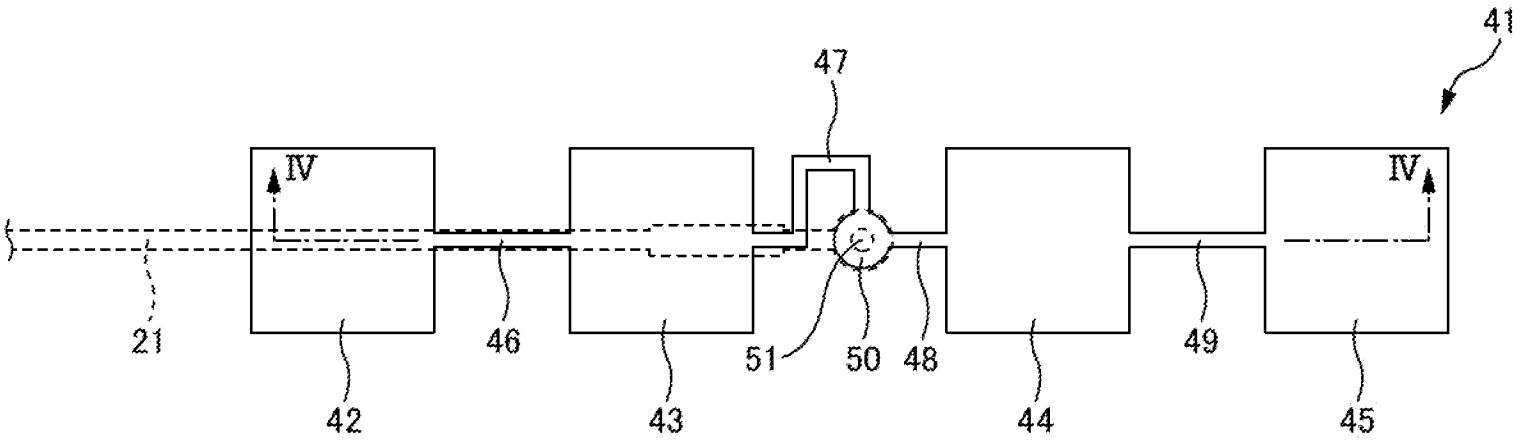
FIG. 3 is a plan view of an element row provided in an antenna according to a first embodiment.
Figure 4:
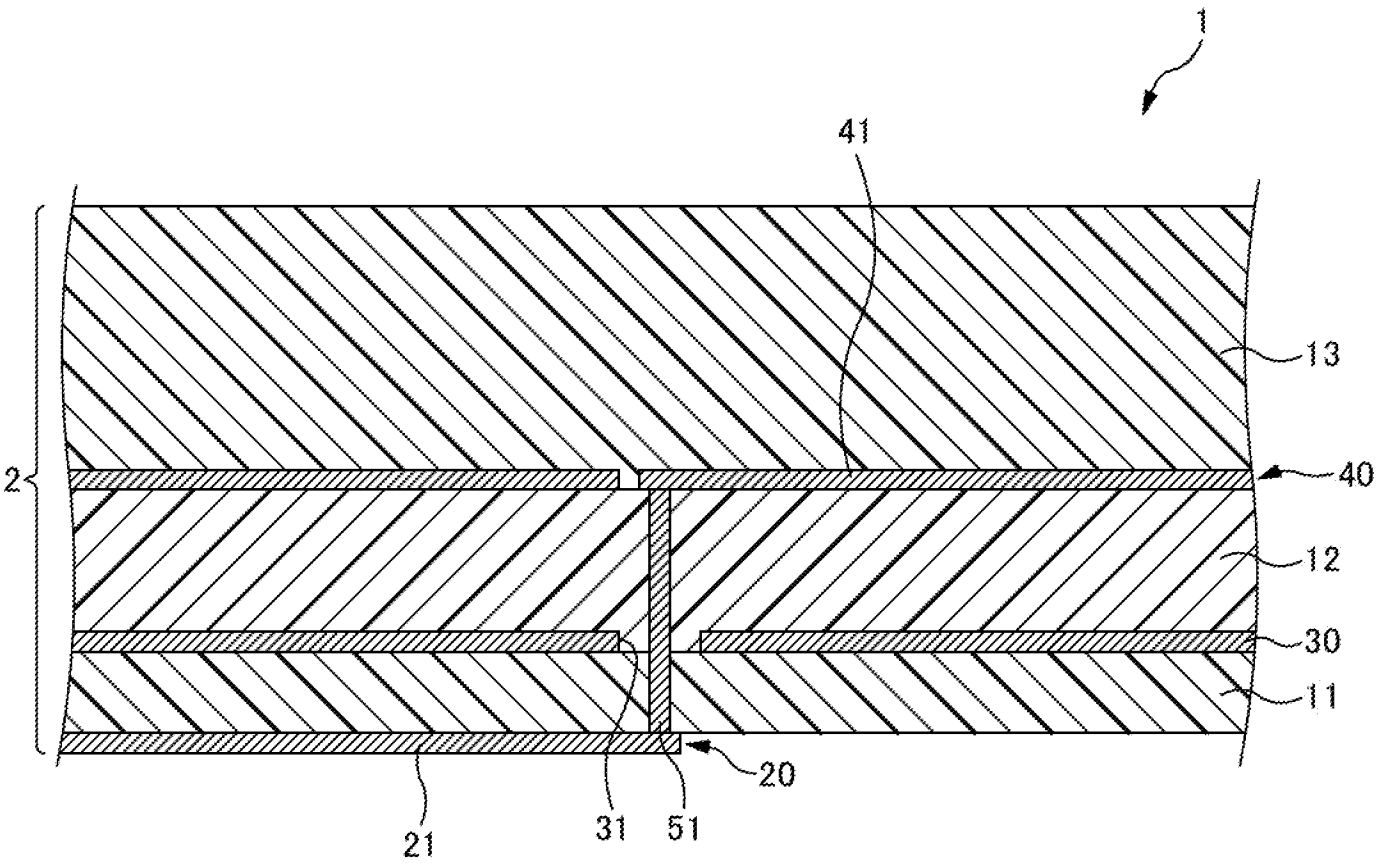
FIG. 4 is a cross-sectional view illustrating a cut place taken along IV-IV of FIG. 3.

FIG. 1 is a perspective view obtained with a bird's eye view of an antenna 1 according to a first embodiment. FIG. 2 is a front view of the antenna 1 when viewed in a direction of an arrow A illustrated in FIG. 1. FIG. 3 is a plan view of an element row 41 provided in the antenna 1. FIG. 4 is a cross-sectional view illustrating a cut place taken along IV-IV of FIG. 3. In FIGS. 1 and 2, an X-axis, a Y-axis, and a Z-axis are each illustrated as an auxiliary line or a symbol representing a direction. The X-axis, the Y-axis, and the Z-axis are orthogonal to one another. The direction of an arrow of each of the X-axis, the Y-axis, and the Z-axis is a positive direction, and the direction opposite to the direction of the arrow is a negative direction.

The antenna 1 is used for transmitting, receiving, or both transmitting and receiving a radio wave in a frequency band of a microwave or a millimeter wave. The antenna 1 is formed of a sheet-shaped laminated body 2 having flexibility. The laminated body 2 includes a conductive pattern layer 20, a first dielectric layer 11, a conductive ground layer 30, a second dielectric layer 12, an antenna pattern layer 40, and a third dielectric layer 13. The conductive pattern layer 20, the first dielectric layer 11, the conductive ground layer 30, the second dielectric layer 12, the antenna pattern layer 40, and the third dielectric layer 13 are laminated in this order, and the laminated body 2 is formed in a sheet shape.

The flexible first dielectric layer 11 and the flexible second dielectric layer 12 are bonded to each other, with the conductive ground layer 30 being sandwiched therebetween. The dielectric layers 11 and 12 are formed from, for example, a liquid crystal polymer.

The conductive ground layer 30 is formed between the first dielectric layer 11 and the second dielectric layer 12.

The conductive pattern layer 20 is formed on a surface of the first dielectric layer 11 on a side opposite to the conductive ground layer 30 with respect to the first dielectric layer 11.

The second dielectric layer 12 and the third dielectric layer 13 are bonded to each other, with the antenna pattern layer 40 being sandwiched therebetween. The antenna pattern layer 40 is formed between the second dielectric layer 12 and the third dielectric layer 13. The third dielectric layer 13 is formed from, for example, a liquid crystal polymer.

As described above, the conductive pattern layer 20, the first dielectric layer 11, the conductive ground layer 30, the second dielectric layer 12, the antenna pattern layer 40, and the third dielectric layer 13 are laminated in this order. A radio frequency integrated circuit (RFIC) 90 is mounted on the surface of such a laminated body 2, in other words, the surface of the first dielectric layer 11.

The antenna pattern layer 40 is shape-processed by an additive method, a subtractive method, or the like, thereby forming an even number (for example, 16 rows) of the element rows 41 arranged in parallel in the antenna pattern layer 40. A surface on which the element rows 41 are arranged in parallel, in other words, the antenna pattern layer 40, results in a radiation surface.

Each of the element rows 41 includes patch-type radiation elements 42 to 45, feed lines 46, 47, 48, and 49, and a land portion 50.

The radiation elements 42 to 45 are linearly aligned in a row in a Y-axis direction at intervals in this order. The alignment direction of the radiation elements 42 to 45 is orthogonal to a direction in which the plurality of element rows 41 are arranged in parallel. It is assumed here that, in the element row 41, the radiation element 42 is set at a leading end and the radiation element 45 is set at a tail end.

The radiation elements 42 to 45 are connected in series as follows.

The leading-end radiation element 42 and the second radiation element 43 are connected in series to each other with the feed line 46 provided therebetween. The land portion 50 is provided at the center of the element row 41, in other words, between the second radiation element 43 and the third radiation element 44. The second radiation element 43 and the land portion 50 are connected in series to each other with the feed line 47 provided therebetween. The third radiation element 44 and the land portion 50 are connected in series to each other with the feed line 48 provided therebetween. The third radiation element 44 and the last radiation element 45 are connected in series to each other with the feed line 49 provided therebetween. The feed lines 46, 48, and 49 are linearly formed, and the feed line 47 is bent. The electrical length of the feed line 48 is shorter than the electrical length of each of the feed lines 46, 47, and 49.

Note that each of the element rows 41 is a series-connection body of the four radiation elements 42 to 45, but it is not limited thereto as long as the number of radiation elements is an even number. However, the element row 41 preferably includes four, six, or eight radiation elements.

The even-numbered element rows 41 (for example, 16 rows) are aligned at an equal pitch in a direction orthogonal to the alignment direction of the radiation elements 42 to 45. In this case, the radiation elements 42 in the respective element rows 41 are aligned in a row in the direction orthogonal to the alignment direction of the radiation elements 42 to 45, and the positions of the radiation elements 42 are aligned in the direction orthogonal to the alignment direction of the radiation elements 42. The same applies to the radiation elements 43 in the respective element rows 41. The same applies to the radiation elements 44 in the respective element rows 41. The same applies to the radiation elements 45 in the respective element rows 41. Note that the alignment order of the radiation elements 42 to 45 in each of the element rows 41 included in a group G1 described below may be the reverse to the alignment order of the radiation elements 42 to 45 in each of the element rows 41 included in a group G2.

The conductive ground layer 30 is shape-processed by an additive method, a subtractive method, or the like, and thus a slot 31 is formed in the conductive ground layer 30 for each element row 41. The slot 31 faces the center of each of the element rows 41, in other words, each of the land portions 50.

The conductive pattern layer 20 is shape-processed by an additive method, a subtractive method, or the like, thereby forming a feed line 21 in the conductive pattern layer 20 for each of the element rows 41. The feed line 21 is, for example, a microstrip line provided from a terminal of the RFIC 90 to a position at which the slot 31 and the land portion 50 face each other. One end portion of the feed line 21 faces the slot 31 and the land portion 50, and the one end portion is electrically connected to the land portion 50 through a through hole 51. The other end portion of the feed line 21 is connected to the terminal of the RFIC 90. Thus, power is fed from the RFIC 90 to the element row 41 via the feed line 21 and the through hole 51. The through hole 51 penetrates the conductive ground layer 30 in the slot 31. The through hole 51 is insulated from the conductive ground layer 30. The electrical lengths from respective terminals of the RFIC 90 to respective land portions 50 are equal to each other. Note that the land portion 50 and one end portion of the feed line 21 may be electromagnetically coupled together via the slot 31 without providing the through hole 51.

The antenna 1 as described above, in other words, the laminated body 2 of the conductive pattern layer 20, the first dielectric layer 11, the conductive ground layer 30, the second dielectric layer 12, the antenna pattern layer 40, and the third dielectric layer 13 is bent so as to be mountain-folded along a bending line 4 located at the center of the parallel arrangement of the element rows 41. The mountain-folding refers to the laminated body 2 being bent, with the radiation surface, in other words, the antenna pattern layer 40, facing outward. The center of the parallel arrangement of the element rows 41 refers to the center of a set of the element rows 41 arranged in parallel, in other words, a place at which the even-numbered element rows 41 are equally divided into two groups G1 and G2 using the bending line 4 as a boundary. The bending line 4 along which a mountain-folding is performed, in other words, a ridge line 4 is parallel to the alignment direction of the radiation elements 42 to 45. Note that cutting may be formed in the laminated body 2 along a part (for example, a part closer to the RFIC 90 illustrated in FIG. 1) or all of the bending line 4, so that the laminated body 2 may be easily bent.

The laminated body 2 of the conductive pattern layer 20, the first dielectric layer 11, the conductive ground layer 30, the second dielectric layer 12, the antenna pattern layer 40, and the third dielectric layer 13 is bent so as to be mountain-folded along the bending line 4, and thus the radiation surface of the element rows 41 included in the group G1 and the radiation surface of the element rows 41 included in the group G2 form an external corner. An angle α of the external corner is greater than 180°. Preferably, the angle α of the external corner is greater than 180° and is equal to or smaller than 270°. However, the angle α may be greater than 270° and smaller than 360°.

In FIG. 2, a bisector 3 of the external corner is parallel to the Z-axis, the direction of the bisector 3 is hereinafter referred to as a reference direction, and an angle formed by being inclined from the reference direction to the X-axis is represented by θ. It is assumed that the angle θ is positive in a turn from the reference direction toward the positive direction of the X-axis, and is negative in a turn from the reference direction toward the negative direction of the X-axis.

An angle β illustrated in FIG. 2 is an angle formed between a plane 5 orthogonal to the bisector 3 and the radiation surface of the element rows 41 included in the group G1. The angle β is also an angle formed between the plane 5 orthogonal to the bisector 3 and the radiation surface of the element rows 41 included in the group G2.

The RFIC 90 controls a phase of a signal wave of each of the feed lines 21, thereby controlling the directivity of the antenna 1 to achieve a wide angle. Controlling the directivity of the antenna 1 by controlling a phase of a signal wave of each of the feed lines 21 is referred to as beam forming.

Specifically, when the RFIC 90 feeds a signal wave having the same phase to each of the feed lines 21, a radio wave has high directivity in the reference direction. As a phase difference between signal waves of the feed lines 21 adjacent to each other increases, a direction in which a radio wave has high directivity is more inclined with respect to the reference direction. This is verified by simulation.

Figure 5:
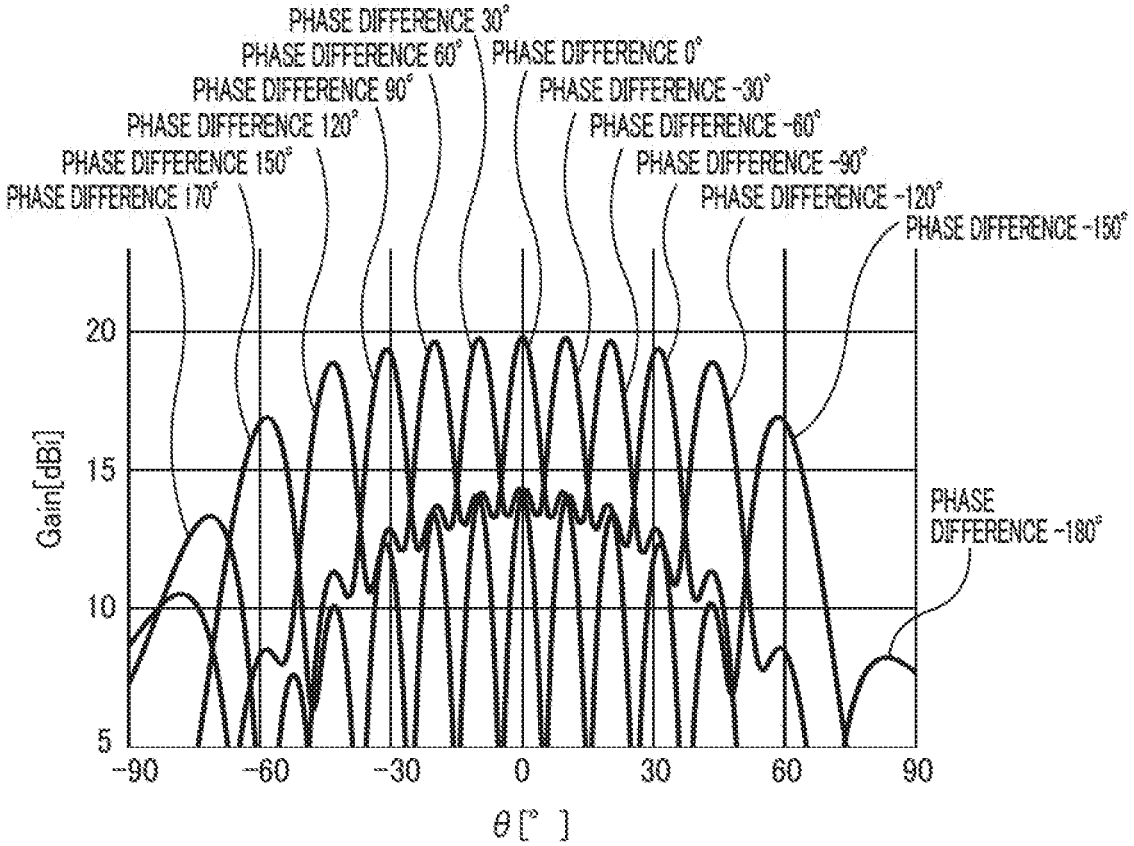
FIG. 5 is a graph illustrating a relationship between a gain and an angle when a phase of each element row of an antenna according to a first embodiment is controlled.
Figure 6:
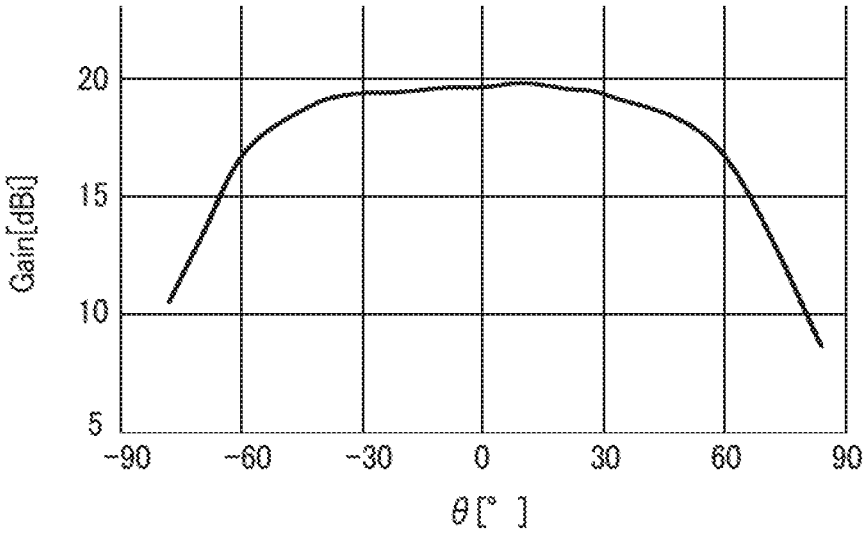
FIG. 6 is a graph illustrating a relationship between a peak of a gain and an angle when a phase of each element row of an antenna according to a first embodiment is controlled.

In a case where the angle β illustrated in FIG. 2 is 2.5°, in other words, in a case where the angle α of the external corner is 185°, and when a phase difference between signal waves of the feed lines 21 adjacent to each other is changed to −180°, −150°, −120°, −90°, −60°, −30°, 0°, 30°, 60°, 90°, 120°, 150°, and 170°, a relationship between a gain and the angle θ is illustrated in FIG. 5. In FIG. 5, a horizontal axis represents the angle θ, and a vertical axis represents the gain. When a phase difference is positive, a phase of a signal wave of the feed line 21 advances from a phase of a signal wave of the feed line 21 adjacent thereto in the negative direction (see FIG. 1) of the X-axis. When a phase difference is negative, a phase of a signal wave of the feed line 21 delays from a phase of a signal wave of the feed line 21 adjacent thereto in the negative direction of the X-axis. As illustrated in FIG. 5, when the phase difference is zero degrees, a peak of the gain appears at the angle θ of zero degrees, and thus the directivity in the reference direction is high. As an absolute value of the phase difference increases, an absolute value of the angle θ at which the peak of the gain appears increases. Thus, as an absolute value of the phase difference increases, a direction in which the directivity of a radio wave is high is more inclined with respect to the reference direction. By connecting the peaks of the gains illustrated in FIG. 5 with a line, a curved line as illustrated in FIG. 6 can be drawn. As illustrated in FIG. 6, it is understood that a range of the angle θ in which the peak of the gain is equal to or greater than 15 dBi is wider than a range of −60° to 60°, and a range in which the directivity of the antenna 1 is controllable to be high is wide.

The distribution (see FIG. 6) of the peaks of the gains of the antenna 1 by phase control substantially has symmetry. This means that the directivity of the antenna 1 in the direction of the negative angle θ and the directivity of the antenna 1 in the direction of the positive angle θ are substantially the same. This is because the group G1 and the group G2 have an equal number of the element rows 41.

Figure 7:
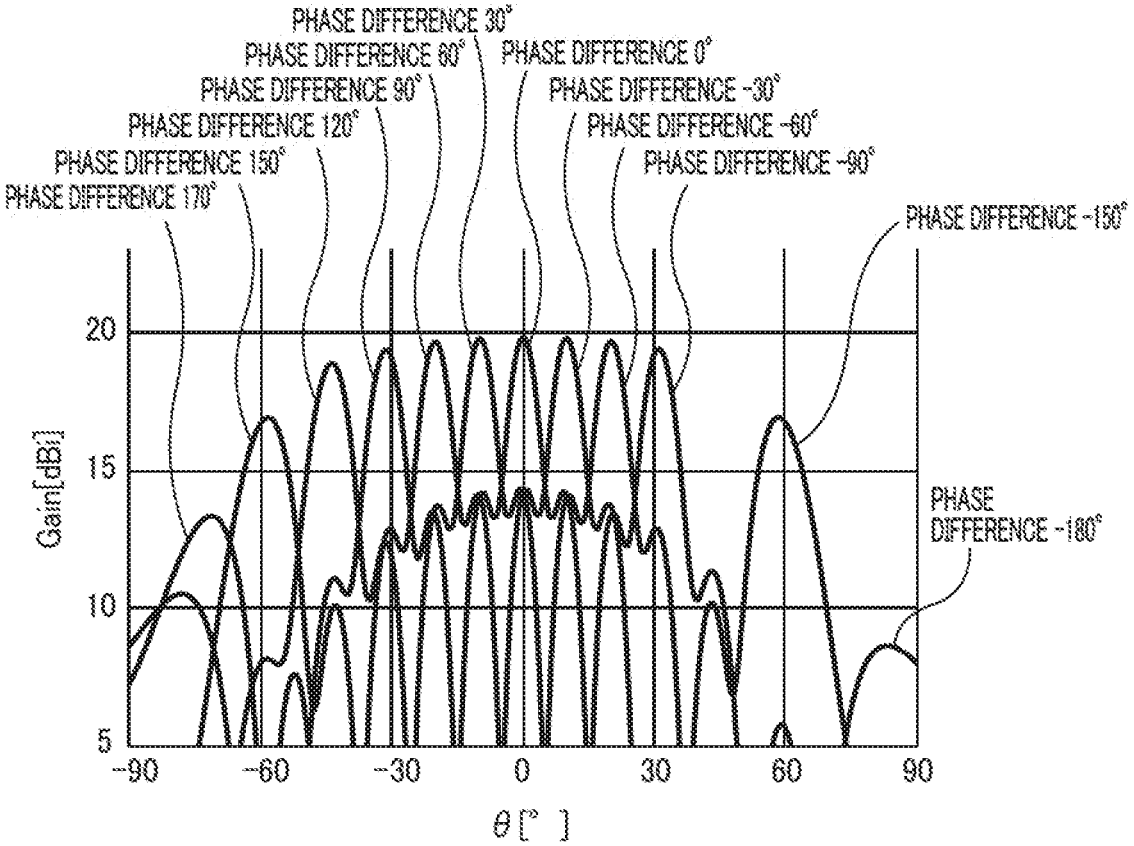
FIG. 7 is a graph illustrating a relationship between a gain and an angle when a phase of each element row of an antenna according to a first embodiment is controlled.
Figure 8:
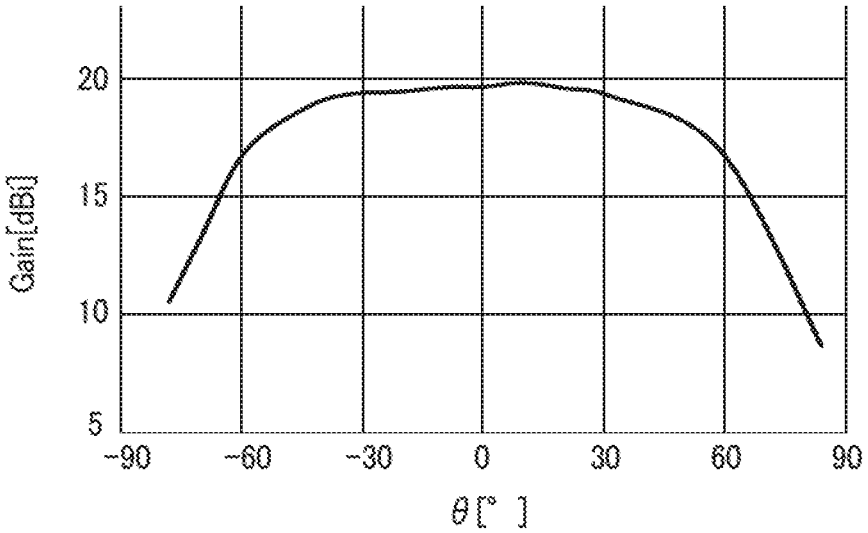
FIG. 8 is a graph illustrating a relationship between a peak of a gain and an angle when a phase of each element row of an antenna according to a first embodiment is controlled.

In a case where the angle β illustrated in FIG. 2 is 5°, and when a phase difference between signal waves of the feed lines 21 adjacent to each other is changed to −180°, −150°, −90θ, −60°, 30°, 0°, 30°, 60°, 90°, 120°, 150°, and 170°, a relationship between a gain and the angle θ is illustrated in FIG. 7. By connecting the peaks of the gains illustrated in FIG. 7 with a line, a curved line as illustrated in FIG. 8 can be drawn. As illustrated in FIG. 8, it is understood that a range of the angle θ in which the peak of the gain is equal to or greater than 15 dBi is wider than a range of −60° to 60°, and a range in which the directivity of the antenna 1 is controllable to be high is wide.

Figure 9:
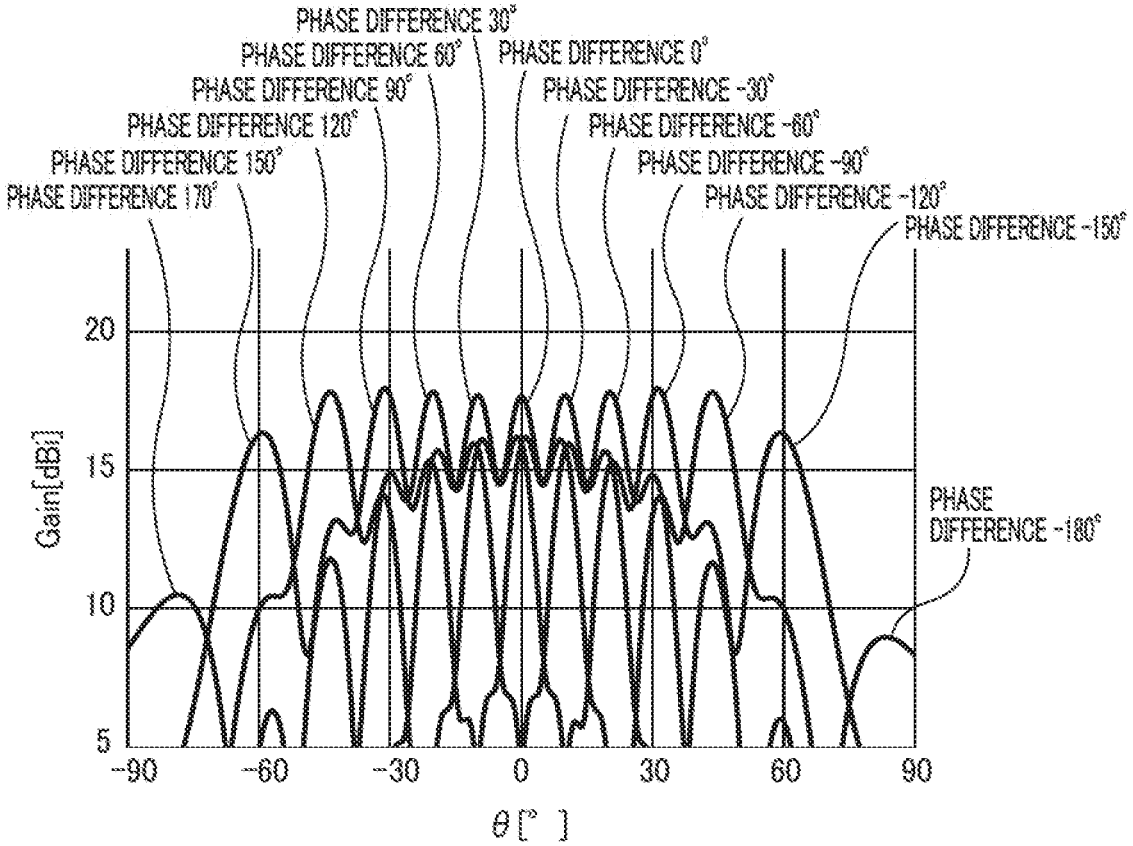
FIG. 9 is a graph illustrating a relationship between a gain and an angle when a phase of each element row of an antenna according to a first embodiment is controlled.
Figure 10:
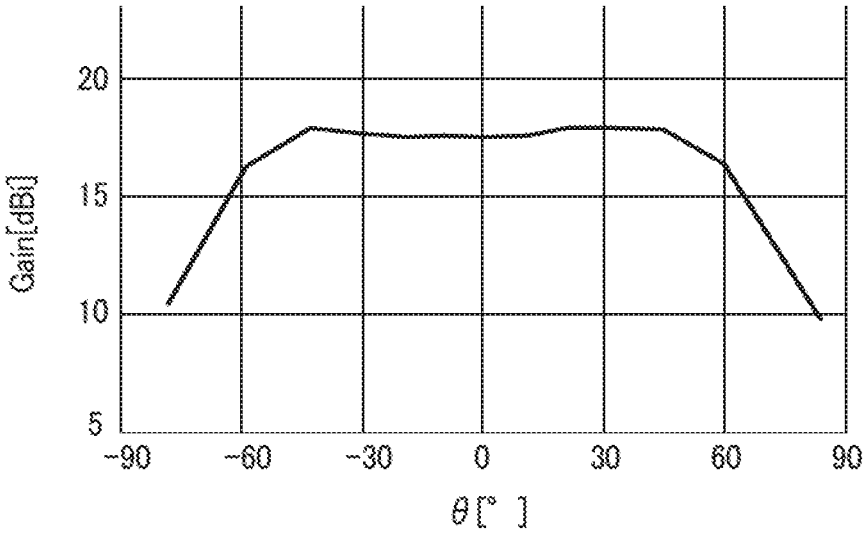
FIG. 10 is a graph illustrating a relationship between a peak of a gain and an angle when a phase of each element row of an antenna according to a first embodiment is controlled.

In a case where the angle β illustrated in FIG. 2 is 7.5°, and when a phase difference between signal waves of the feed lines 21 adjacent to each other is changed to −180°, −150°, −120°, −90°, −60°, −30°, 0°, 30°, 60°, 90°, 120°, 150°, and 170°, a relationship between a gain and the angle θ is illustrated in FIG. 9. By connecting the peaks of the gains illustrated in FIG. 9 with a line, a curved line as illustrated in FIG. 10 can be drawn. As illustrated in FIG. 10, it is understood that a range of the angle θ in which the peak of the gain is equal to or greater than 15 dBi is wider than a range of −60° to 60°, and a range in which the directivity of the antenna 1 is controllable to be high is wide.

Figure 11:
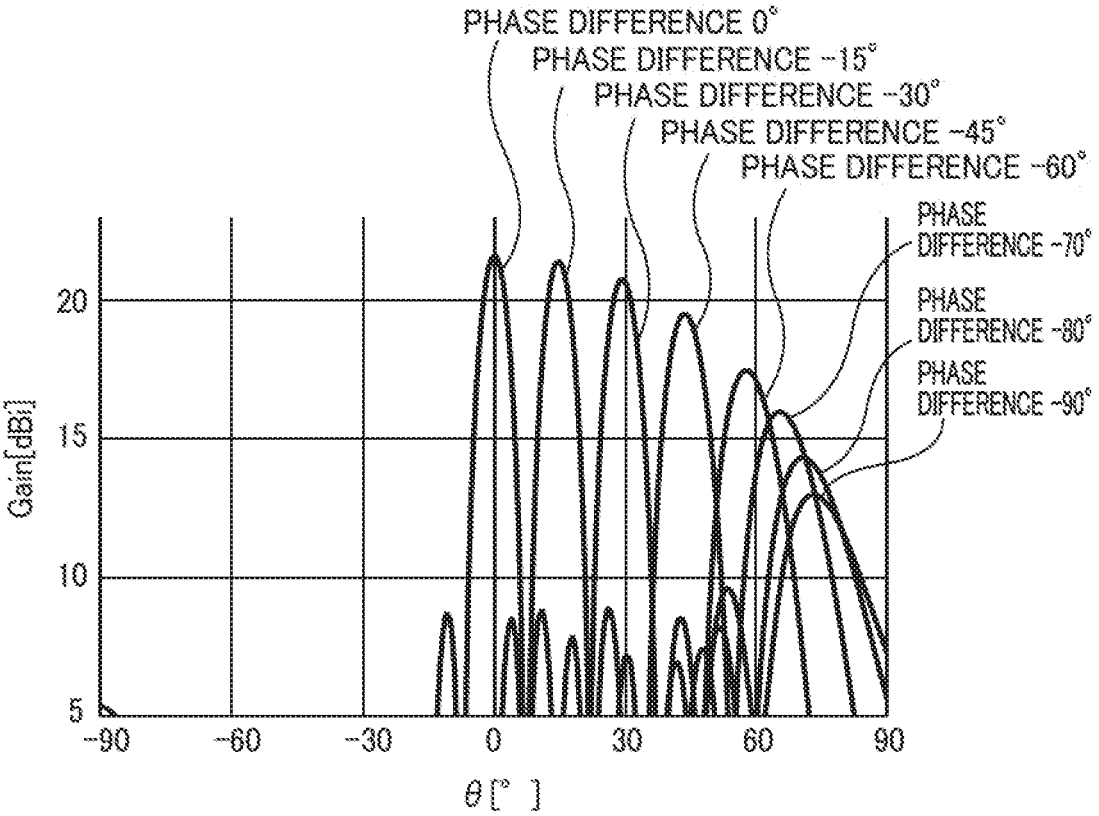
FIG. 11 is a graph illustrating a relationship between a gain and an angle when a phase of each element row of an antenna according to a first embodiment is controlled.
Figure 12:
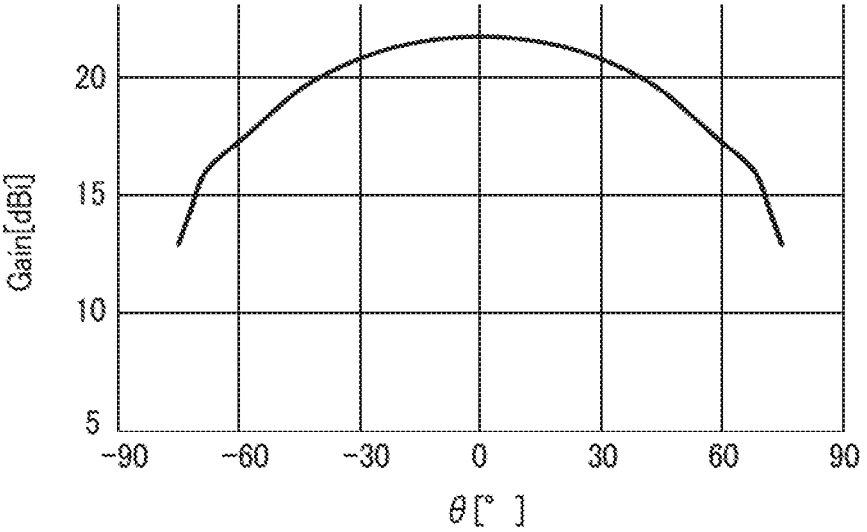
FIG. 12 is a graph illustrating a relationship between a peak of a gain and an angle when a phase of each element row of an antenna according to a first embodiment is controlled.

In a case where the angle β illustrated in FIG. 2 is 10°, when a phase difference between signal waves of the feed lines 21 adjacent to each other is changed to −90°, −80°, −70°, 60°, 45°, 30°, −15°, and 0°, a relationship between a gain and the angle θ is illustrated in FIG. 11. FIG. 12 illustrates a curved line obtained by connecting the peaks of the gains illustrated in FIG. 11 with a line and complementing the line in a line symmetrical manner.

Figure 13:
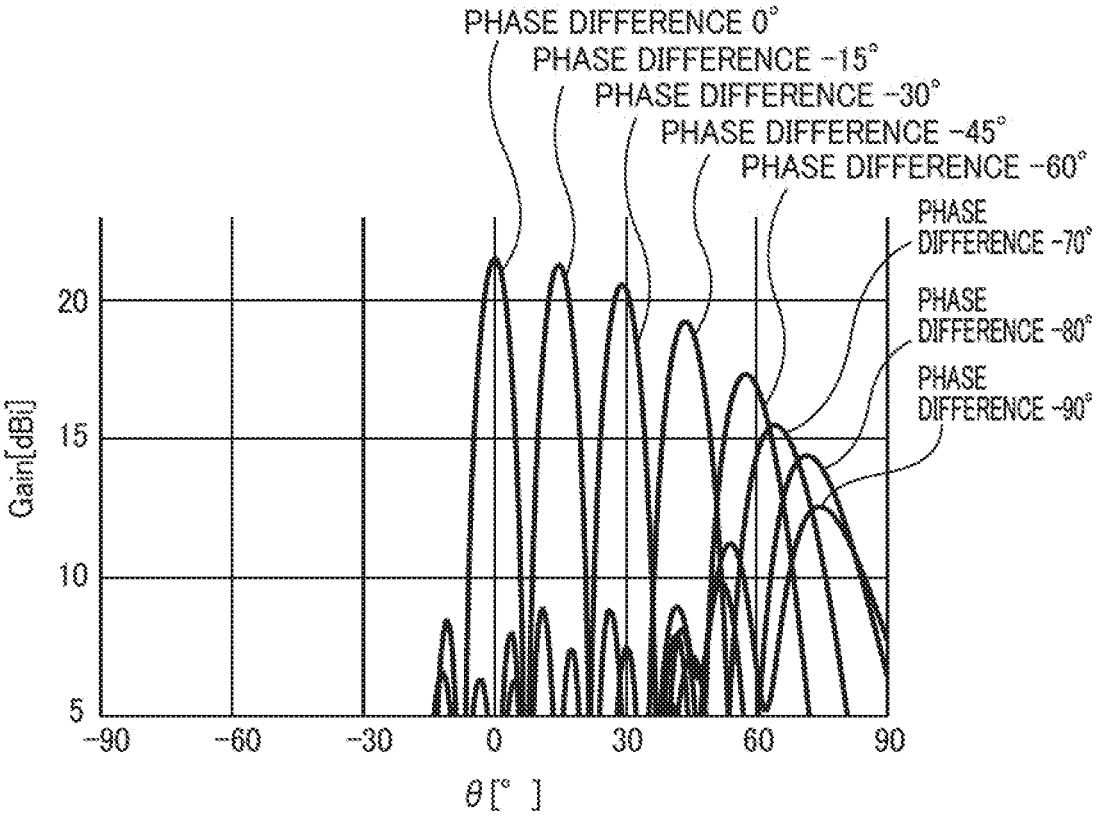
FIG. 13 is a graph illustrating a relationship between a gain and an angle when a phase of each element row of an antenna according to a first embodiment is controlled.
Figure 14:
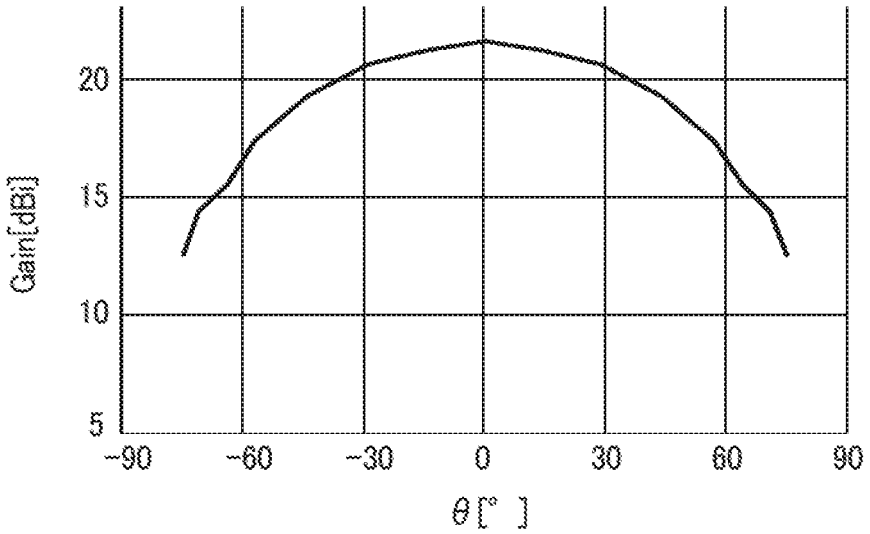
FIG. 14 is a graph illustrating a relationship between a peak of a gain and an angle when a phase of each element row of an antenna according to a first embodiment is controlled.

In a case where the angle β illustrated in FIG. 2 is 15°, when a phase difference between signal waves of the feed lines 21 adjacent to each other is changed to −90°, −80°, −70°, −60°, −45°, −30°, −15°, and 0°, a relationship between a gain and the angle θ is illustrated in FIG. 13. FIG. 14 illustrates a curved line obtained by connecting the peaks of the gains illustrated in FIG. 13 with a line and complementing the line in a line symmetrical manner.

Figure 15:
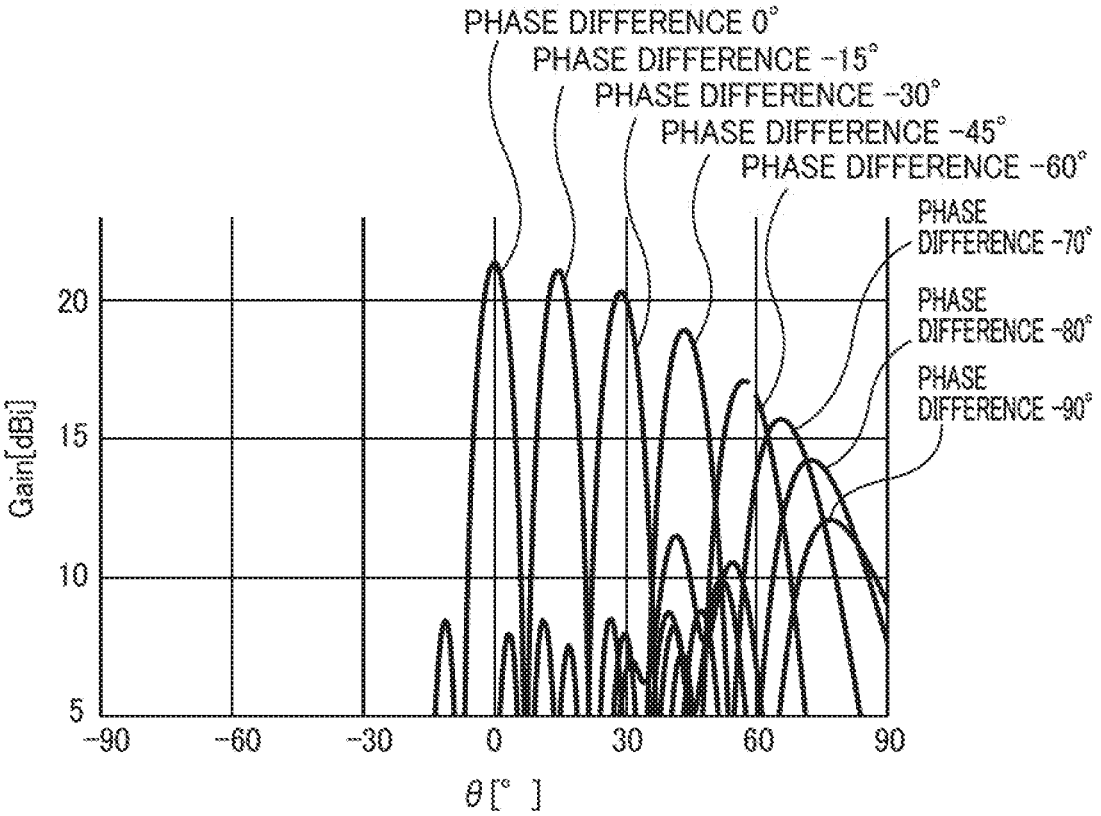
FIG. 15 is a graph illustrating a relationship between a gain and an angle when a phase of each element row of an antenna according to a first embodiment is controlled.
Figure 16:
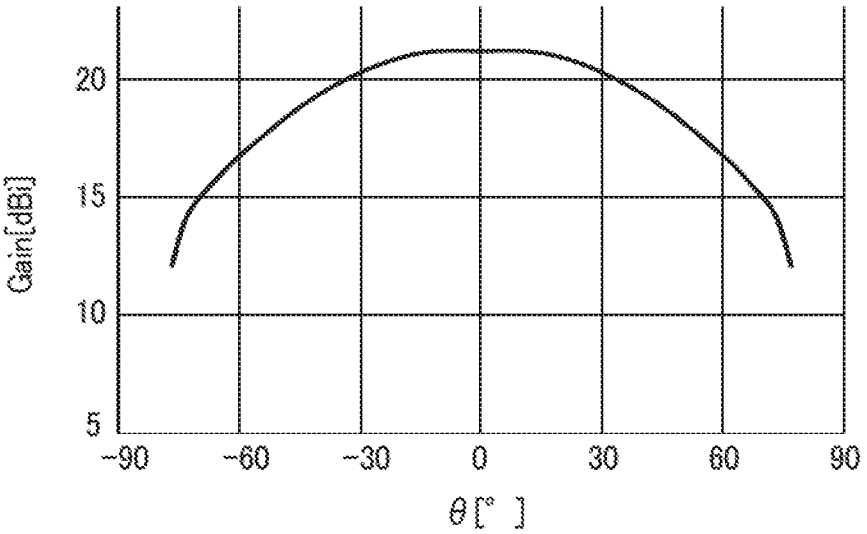
FIG. 16 is a graph illustrating a relationship between a peak of a gain and an angle when a phase of each element row of an antenna according to a first embodiment is controlled.

In a case where the angle β illustrated in FIG. 2 is 20°, and when a phase difference between signal waves of the feed lines 21 adjacent to each other is changed to −90°, −80°, −70°, −60°, −45°, −30°, −15°, and 0°, a relationship between a gain and the angle θ is illustrated in FIG. 15. FIG. 16 illustrates a curved line obtained by connecting the peaks of the gains illustrated in FIG. 15 with a line and complementing the line in a line symmetrical manner.

Figure 17:
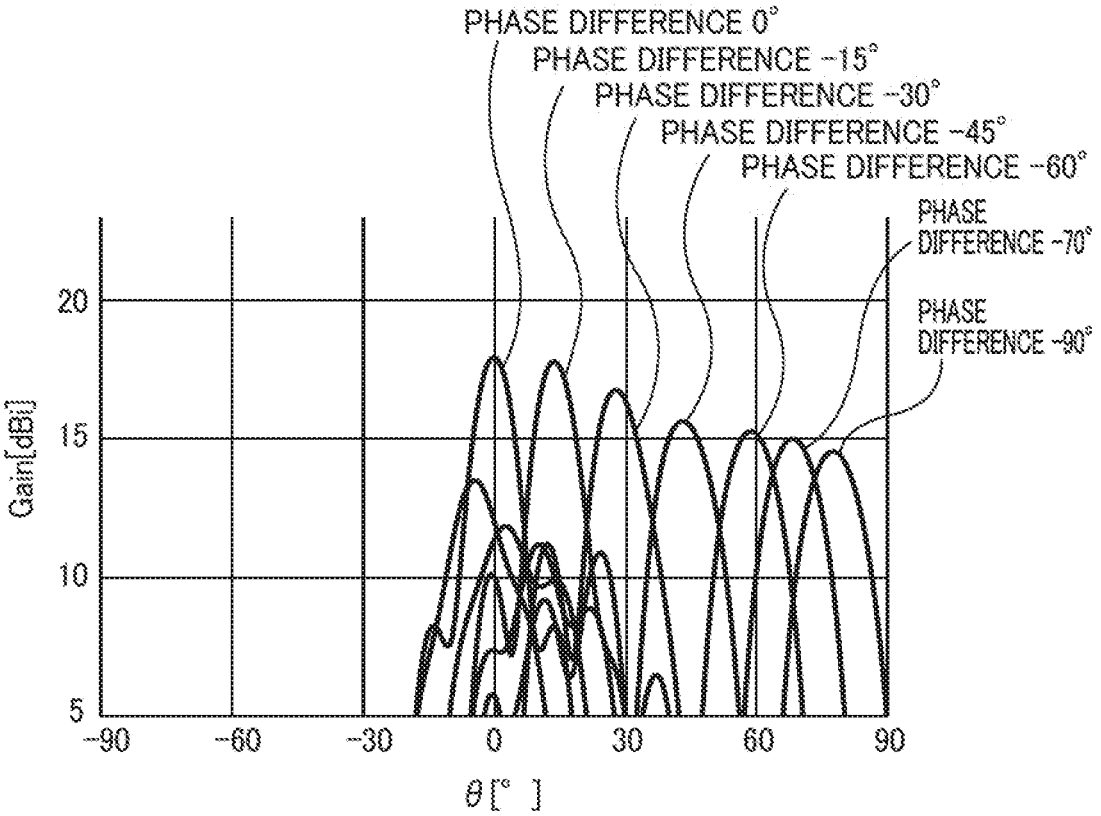
FIG. 17 is a graph illustrating a relationship between a gain and an angle when a phase of each element row of an antenna according to a first embodiment is controlled.
Figure 18:
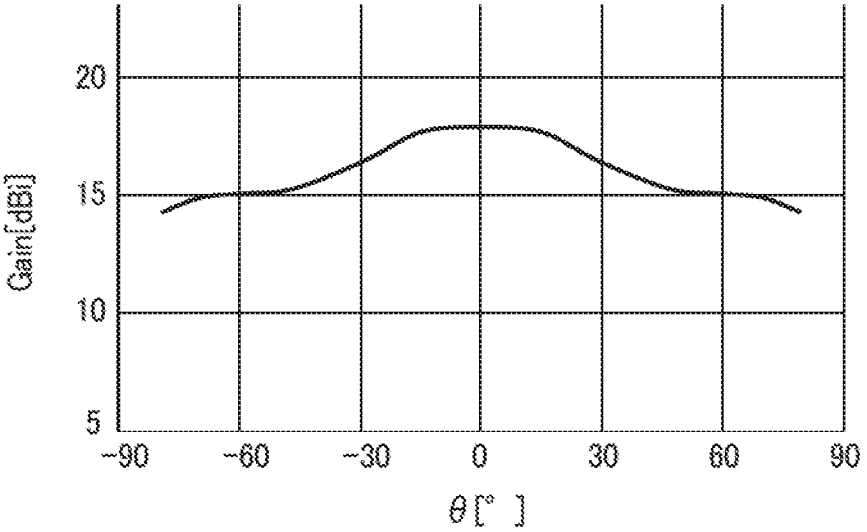
FIG. 18 is a graph illustrating a relationship between a peak of a gain and an angle when a phase of each element row of an antenna according to a first embodiment is controlled.

In a case where the angle β illustrated in FIG. 2 is 50°, when a phase difference between signal waves of the feed lines 21 adjacent to each other is changed to −90°, −70°, −60°, −45°, −30°, −15°, and 0°, a relationship between a gain and the angle θ is illustrated in FIG. 17. FIG. 18 illustrates a curved line obtained by connecting the peaks of the gains illustrated in FIG. 17 with a line and complementing the line in a line symmetrical manner.

As illustrated in FIGS. 12, 14, 16, and 18, a range of the angle θ in which the peak of the gain is equal to or greater than 15 dBi is wider than a range of −60° to 60°. Thus, it is understood that a range in which the directivity of the antenna 1 is controllable to be high is wide.

Figure 19:
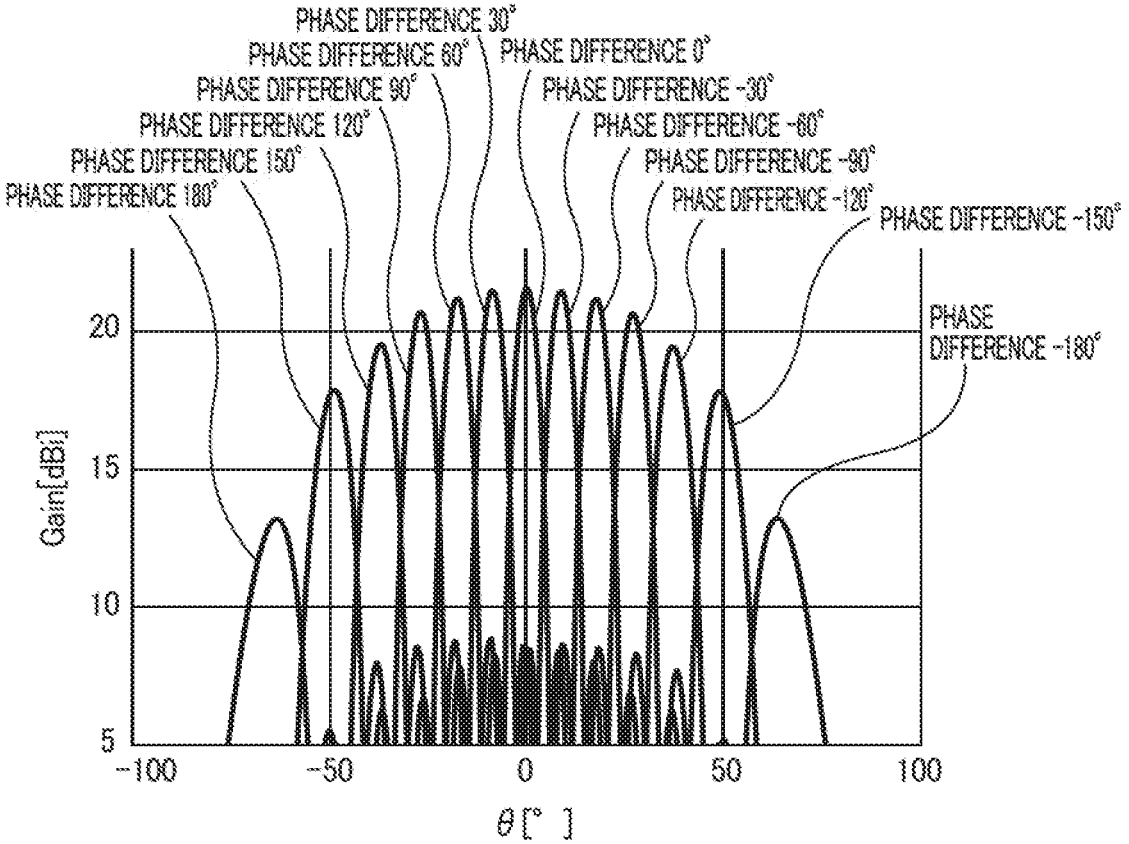
FIG. 19 is a graph illustrating a relationship between a gain and an angle when a phase of each element row of a planar antenna according to a comparison example is controlled.

Subsequently, a case where the laminated body 2 is bent and a case where the laminated body 2 is not bent are compared. In a case where the angle β illustrated in FIG. 2 is zero degrees, in other words, in a case where the laminated body 2 is planar without being bent, and when a phase difference between signal waves of the feed lines 21 adjacent to each other is changed to −180°, −150°, −120°, −90°, −60°, −30°, 0°, 30°, 60°, 90°, 120°, 150°, and 180°, a relationship between a gain and the angle θ is illustrated in FIG. 19. By connecting the peaks of the gains illustrated in FIG. 19 with a line, a curved line as illustrated in FIG. 20 can be drawn.

Figure 20:
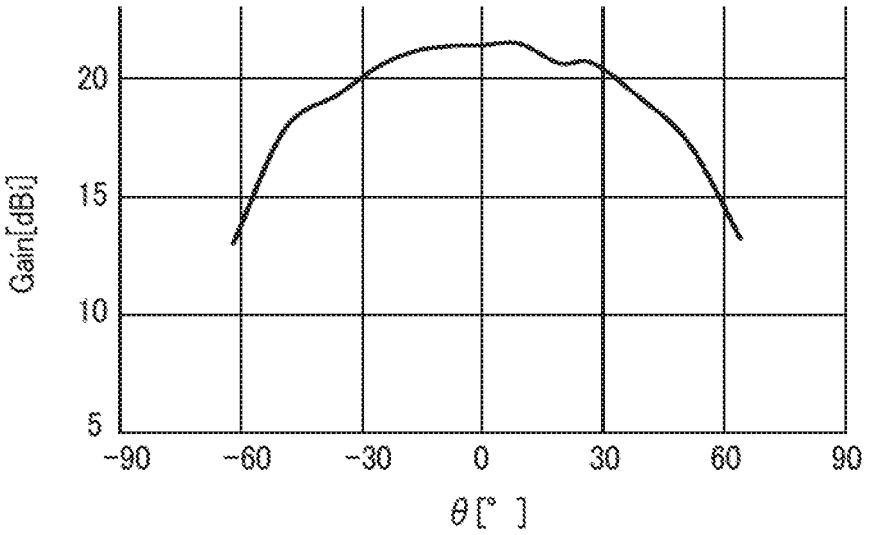
FIG. 20 is a graph illustrating a relationship between a peak of a gain and an angle when a phase of each element row of a planar antenna according to a comparison example is controlled.

In the case where the laminated body 2 is not bent, a range of the angle θ in which the peaks of the gains are equal to or greater than 15 dBi is narrower than the range of −60° to 60° as illustrated in FIG. 20. In contrast, in the case where the laminated body 2 is bent so as to be mountain-folded, the range of the angle θ in which the peaks of the gains are equal to or greater than 15 dBi is wider than the range of −60° to 60° as illustrated in FIGS. 6, 8, 10, 12, 14, 16, and 18. Accordingly, it is understood that a range of the angle in which the directivity of the antenna 1 is controllable to be high is widened, with the laminated body 2 being bent.

Second Embodiment

Figure 21:
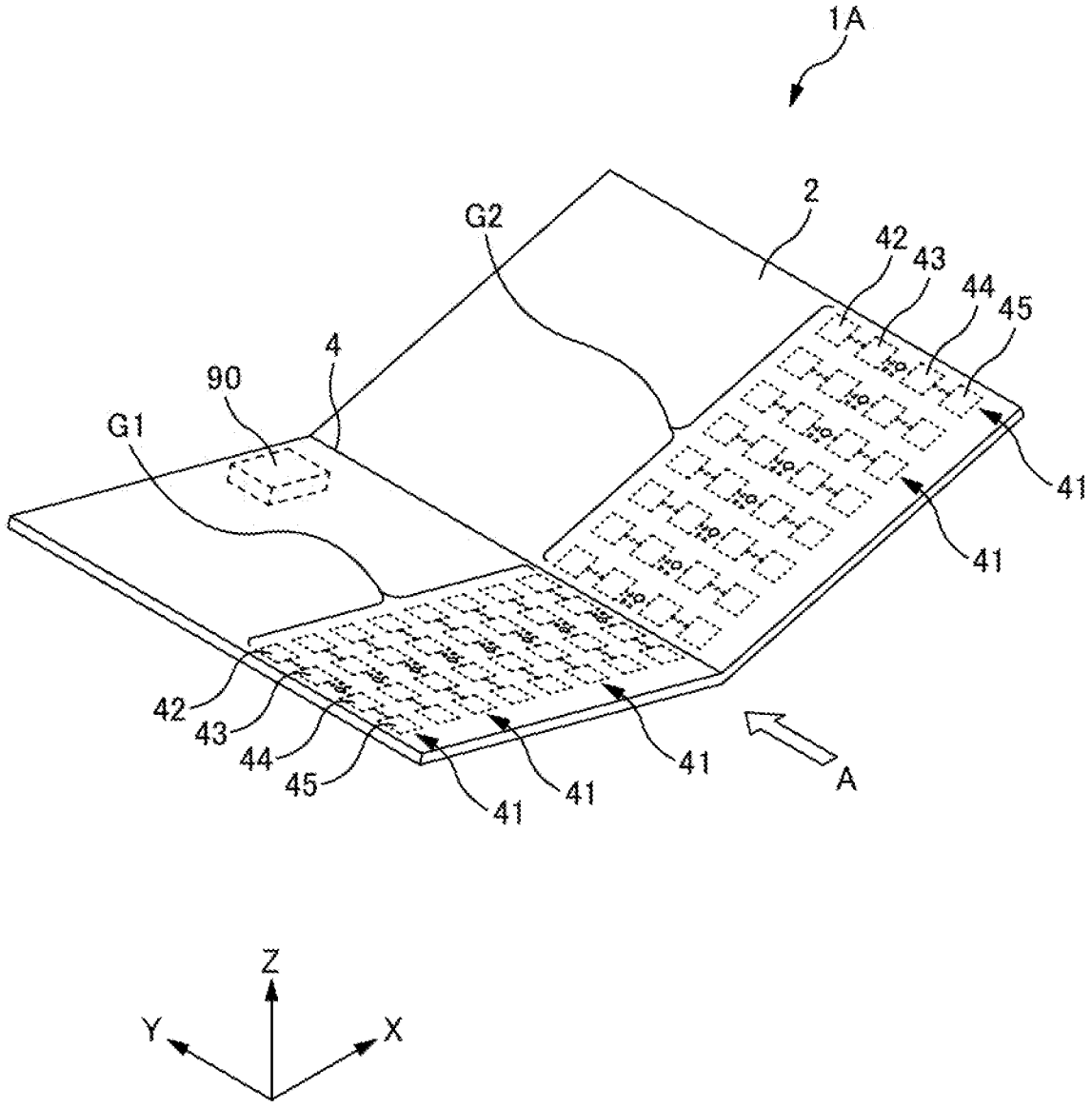
FIG. 21 is a perspective view of an antenna according to a second embodiment.
Figure 22:
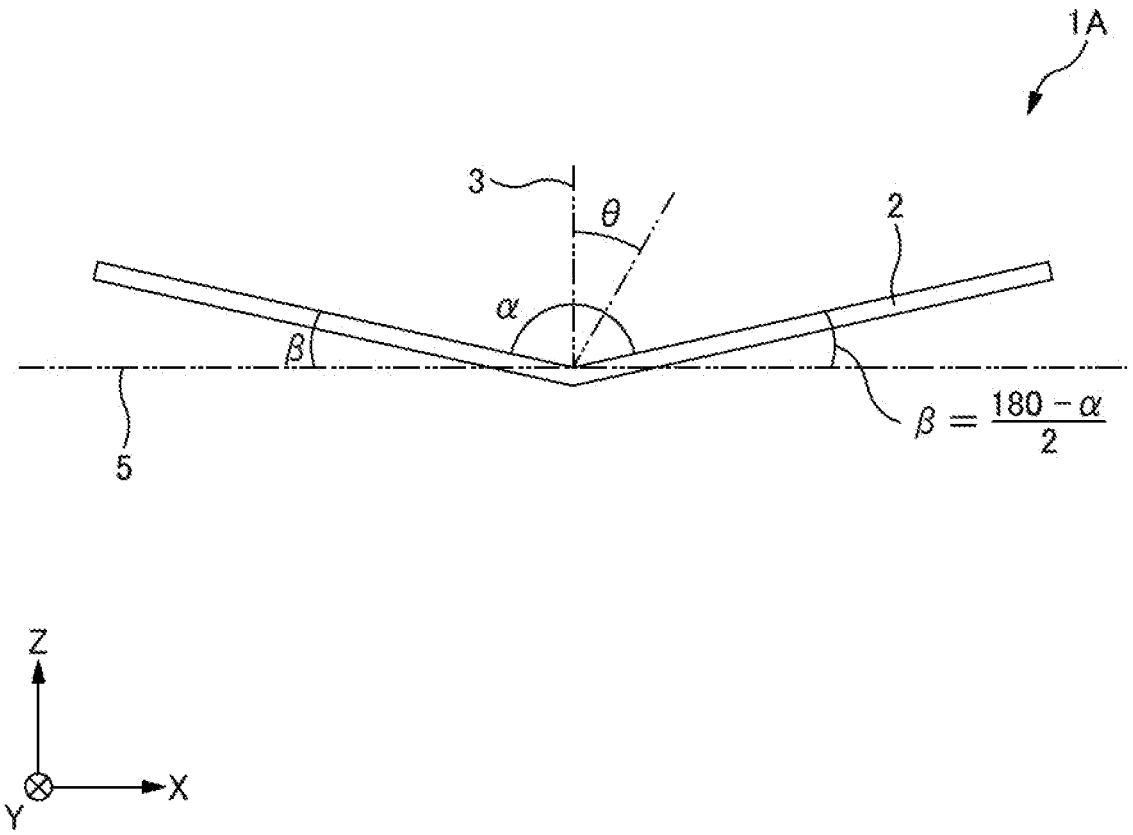
FIG. 22 is a front view of an antenna according to a second embodiment.

FIG. 21 is a perspective view obtained with a bird's eye view of an antenna 1A according to a second embodiment. FIG. 22 is a front view of the antenna 1A when viewed in a direction of an arrow A illustrated in FIG. 21.

In the first embodiment, the laminated body 2 is bent so as to be mountain-folded at the center of the parallel arrangement of the element rows 41, as illustrated in FIG. 1. In contrast, in the second embodiment, a laminated body 2 is bent so as to be valley-folded at the center of parallel arrangement of element rows 41, as illustrated in FIGS. 21 and 22. The valley-folding refers to the laminated body 2 being bent, with a radiation surface, in other words, a surface on which the element rows 41 are arranged in parallel, facing inward. Hereinafter, the antenna 1A according to the second embodiment will be described in detail.

The laminated body 2 is bent so as to be valley-folded, and thus the radiation surface of the element rows 41 included in a group G1 and the radiation surface of the element rows 41 included in a group G2 form an internal corner. An angle α of the internal corner is smaller than 180°. In FIG. 22, a bisector 3 of the internal corner is parallel to the Z-axis, the direction of the bisector 3 is hereinafter referred to as a reference direction, and an angle formed by being inclined from the reference direction to the X-axis is represented by θ. It is assumed that the angle θ is positive in a turn from the reference direction toward the positive direction of the X-axis, and is negative in a turn from the reference direction toward the negative direction of the X-axis.

An RFIC 90 controls a phase of a signal wave of each of feed lines 21, thereby controlling the directivity of the antenna 1A to achieve a wide angle. This is verified by simulation.

Figure 23:
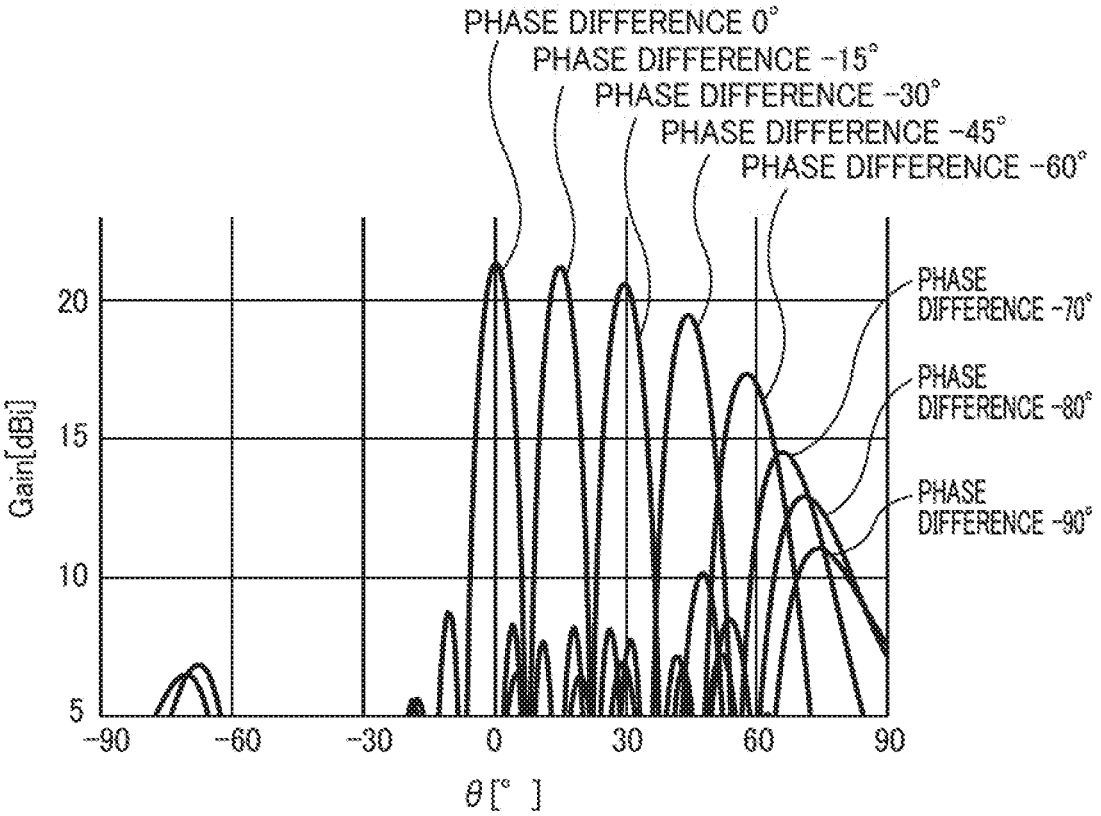
FIG. 23 is a graph illustrating a relationship between a gain and an angle when a phase of each element row of an antenna according to a second embodiment is controlled.
Figure 24:
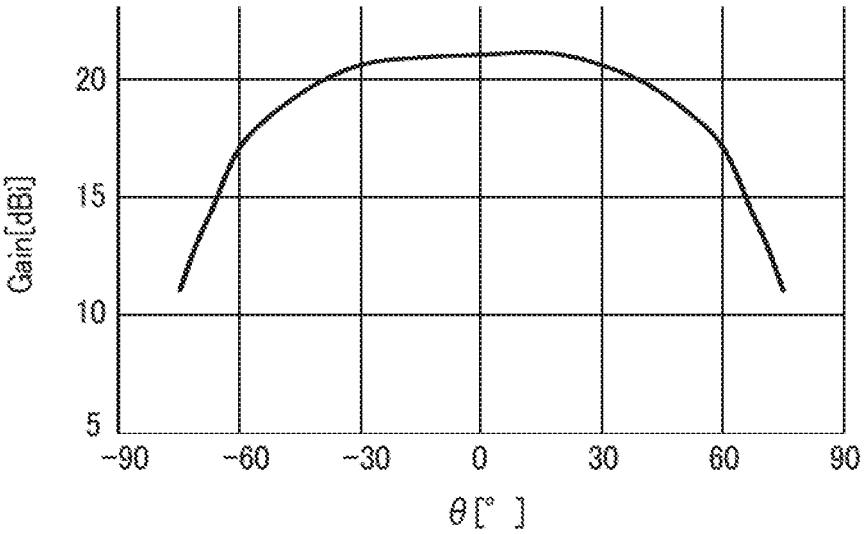
FIG. 24 is a graph illustrating a relationship between a peak of a gain and an angle when a phase of each element row of an antenna according to a second embodiment is controlled.

In a case where an angle β illustrated in FIG. 22 is 10°, in other words, in a case where the angle α of the internal corner is 160°, and when a phase difference between signal waves of the feed lines 21 adjacent to each other is changed to −90°, −80°, −70°, −60°, −45°, −30°, −15°, and 0°, a relationship between a gain and the angle θ is illustrated in FIG. 23. FIG. 24 illustrates a curved line obtained by connecting the peaks of the gains illustrated in FIG. 23 with a line and complementing the line in a line symmetrical manner.

Figure 25:
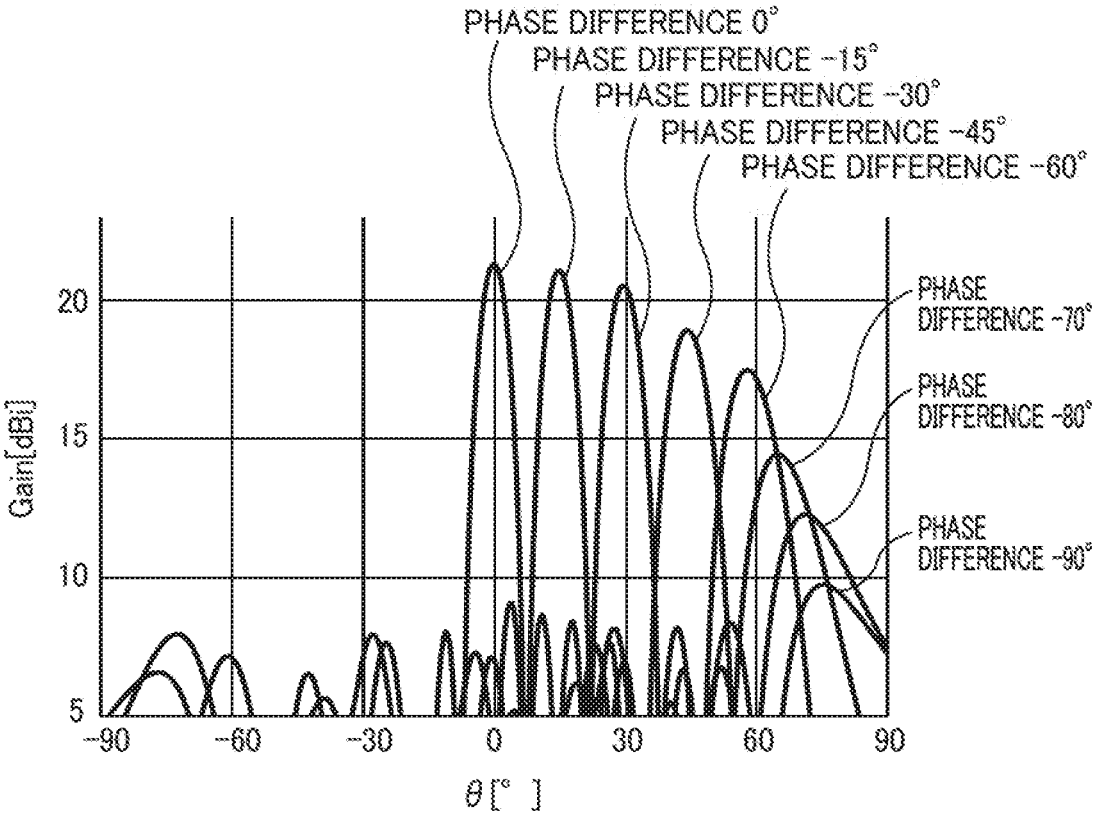
FIG. 25 is a graph illustrating a relationship between a gain and an angle when a phase of each element row of an antenna according to a second embodiment is controlled.
Figure 26:
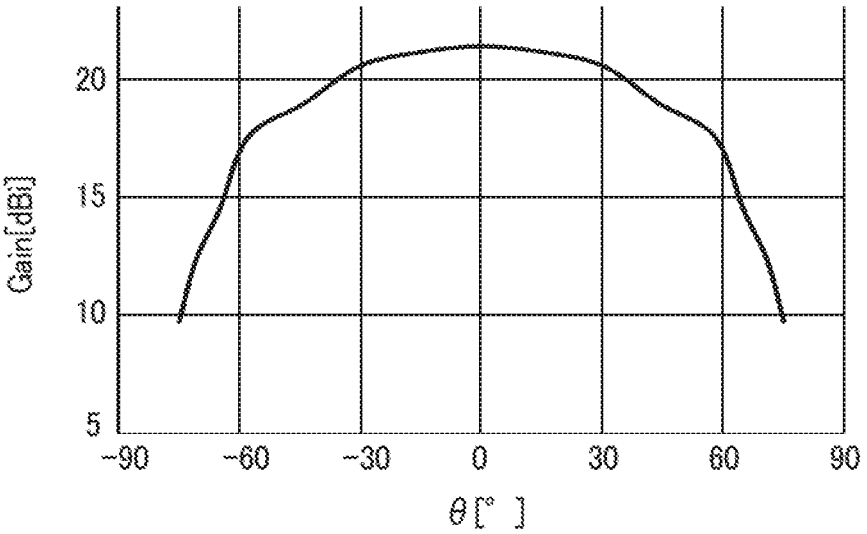
FIG. 26 is a graph illustrating a relationship between a peak of a gain and an angle when a phase of each element row of an antenna according to a second embodiment is controlled.

In a case where the angle β illustrated in FIG. 22 is 15°, when a phase difference between signal waves of the feed lines 21 adjacent to each other is changed to −90°, −80°, −70°, −60°, −45°, −30°, −15°, and 0°, a relationship between a gain and the angle θ is illustrated in FIG. 25. FIG. 26 illustrates a curved line obtained by connecting the peaks of the gains illustrated in FIG. 25 with a line and complementing the line in a line symmetrical manner.

Figure 27:
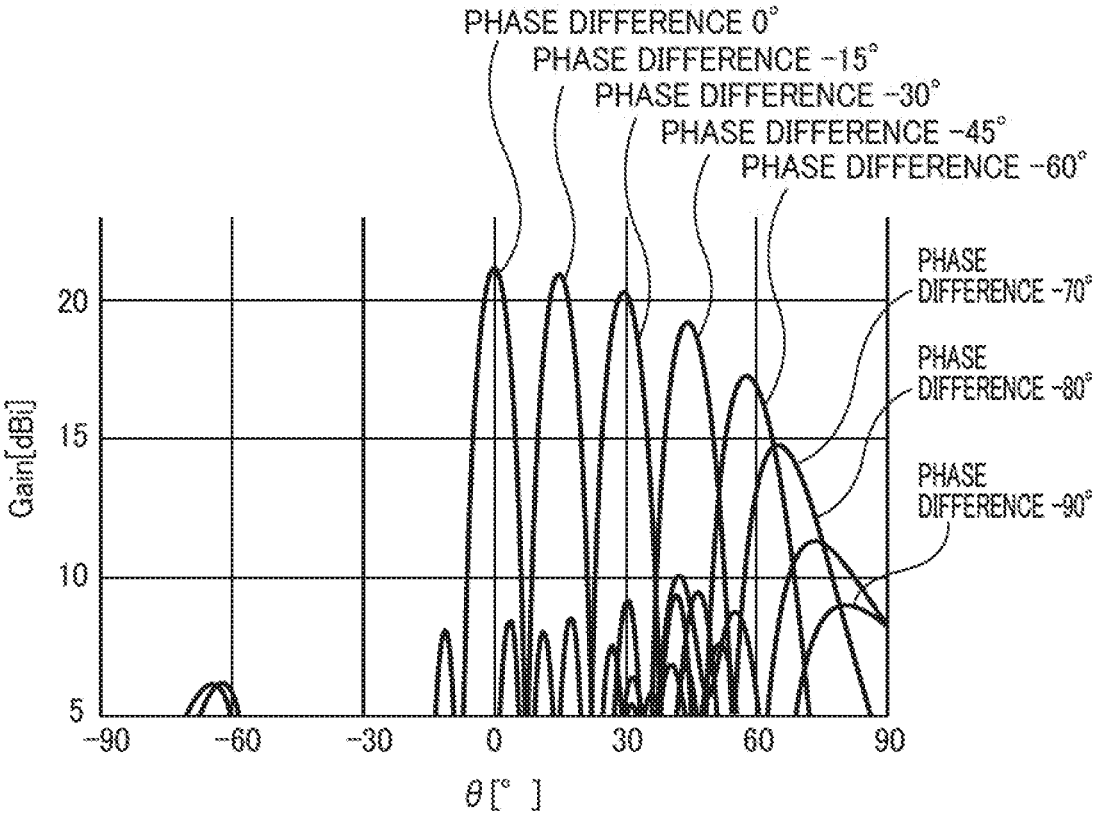
FIG. 27 is a graph illustrating a relationship between a gain and an angle when a phase of each element row of an antenna according to a second embodiment is controlled.
Figure 28:
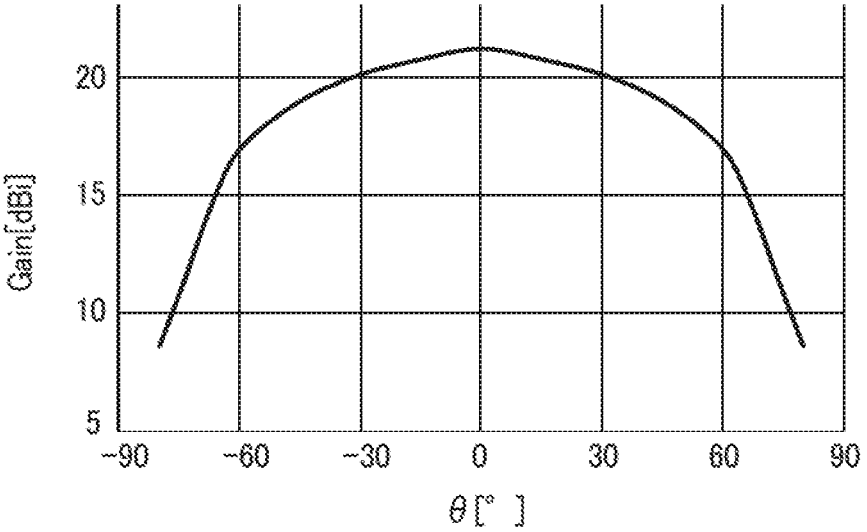
FIG. 28 is a graph illustrating a relationship between a peak of a gain and an angle when a phase of each element row of an antenna according to a second embodiment is controlled.

In a case where the angle β illustrated in FIG. 22 is 20°, and when a phase difference between signal waves of the feed lines 21 adjacent to each other is changed to −90°, −80°, −70°, −60°, −45°, −30°, −15°, and 0°, a relationship between a gain and the angle θ is illustrated in FIG. 27. FIG. 28 illustrates a curved line obtained by connecting the peaks of the gains illustrated in FIG. 27 with a line and complementing the line in a line symmetrical manner.

In the case where the laminated body 2 is bent so as to be valley-folded, as illustrated in FIGS. 24, 26, and 28, a range of the angle θ in which the peak of the gain is equal to or greater than 15 dBi is wider than a range of −60° to 60°. Accordingly, it is understood that, as compared to the case where the laminated body 2 is not bent (see FIG. 20), a range in which the directivity of the antenna 1A is controllable to be high has a wider angle in the case where the laminated body 2 is bent so as to be valley-folded.

Third Embodiment

Figure 29:
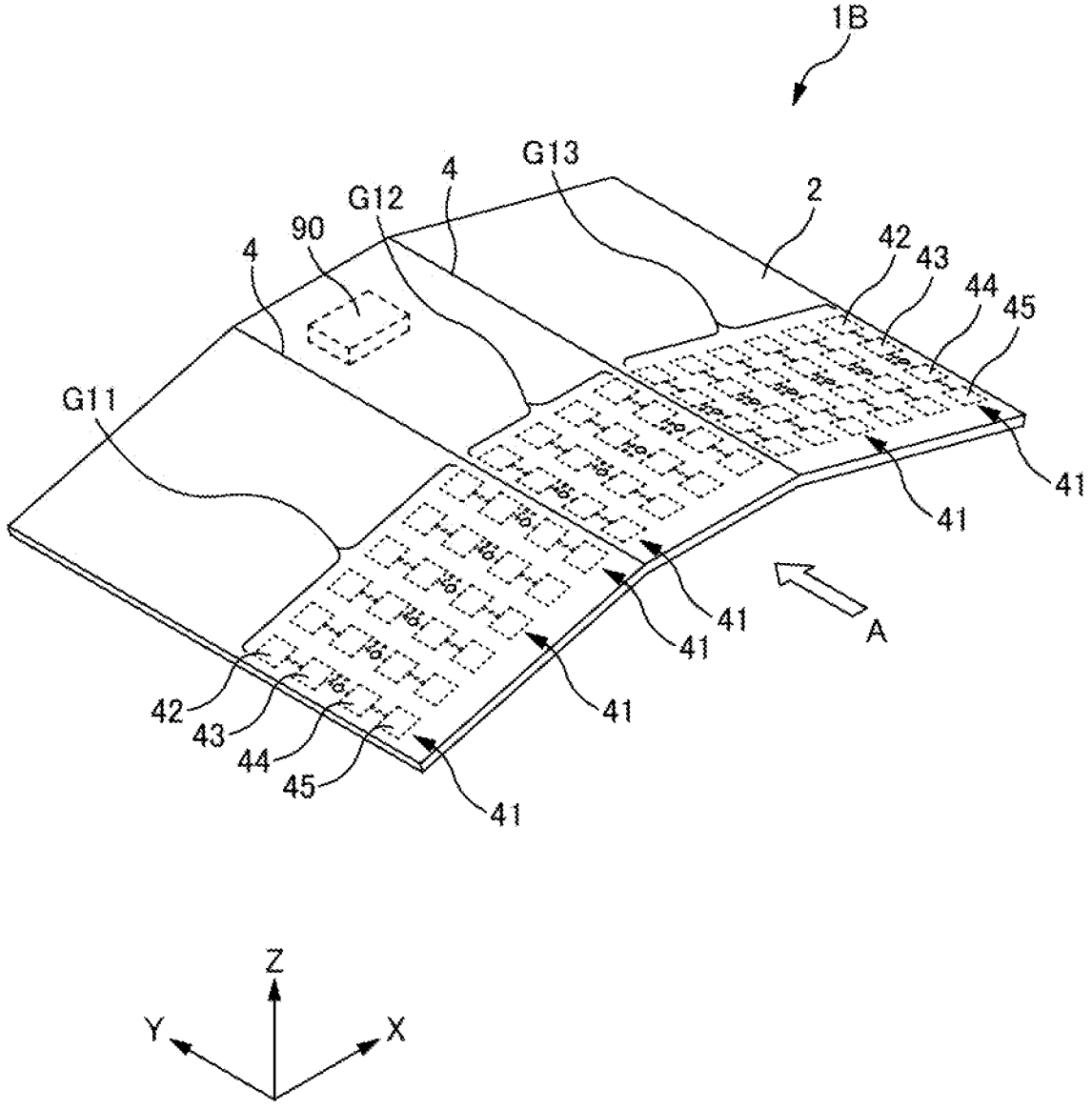
FIG. 29 is a perspective view of an antenna according to a third embodiment.
Figure 30:
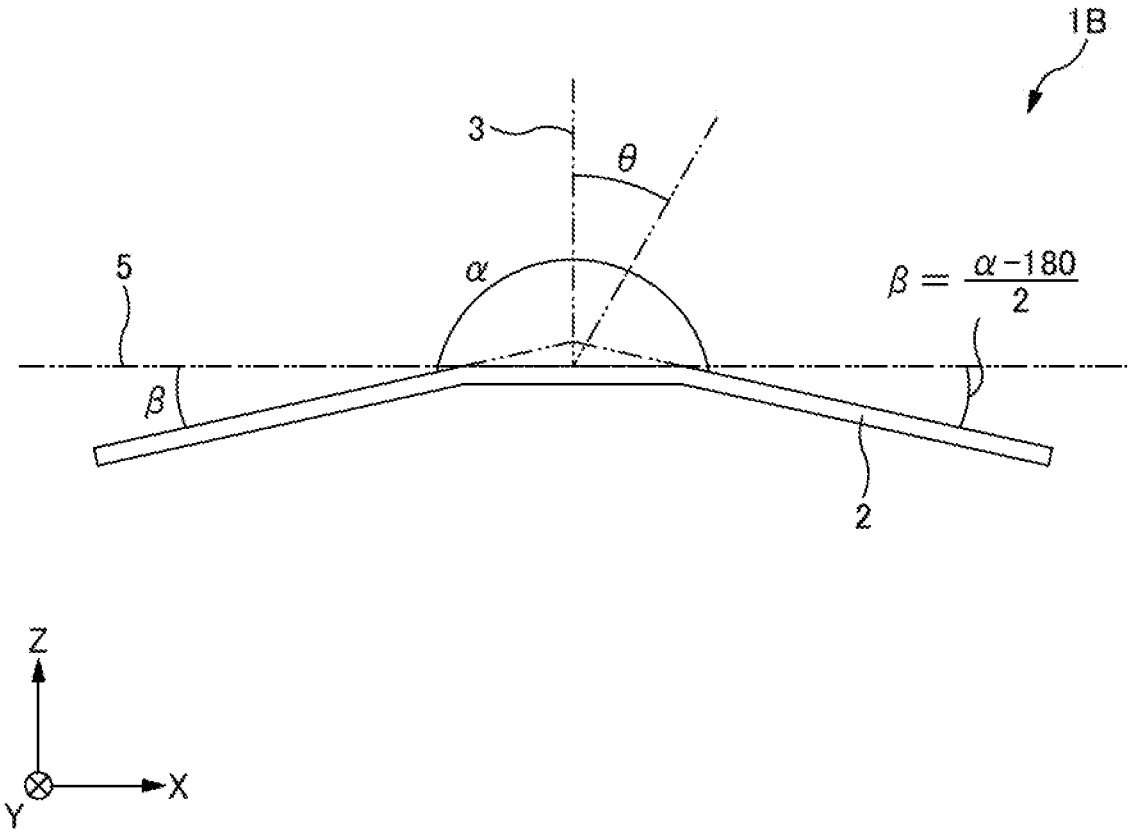
FIG. 30 is a front view of an antenna according to a third embodiment.
Figure 31:
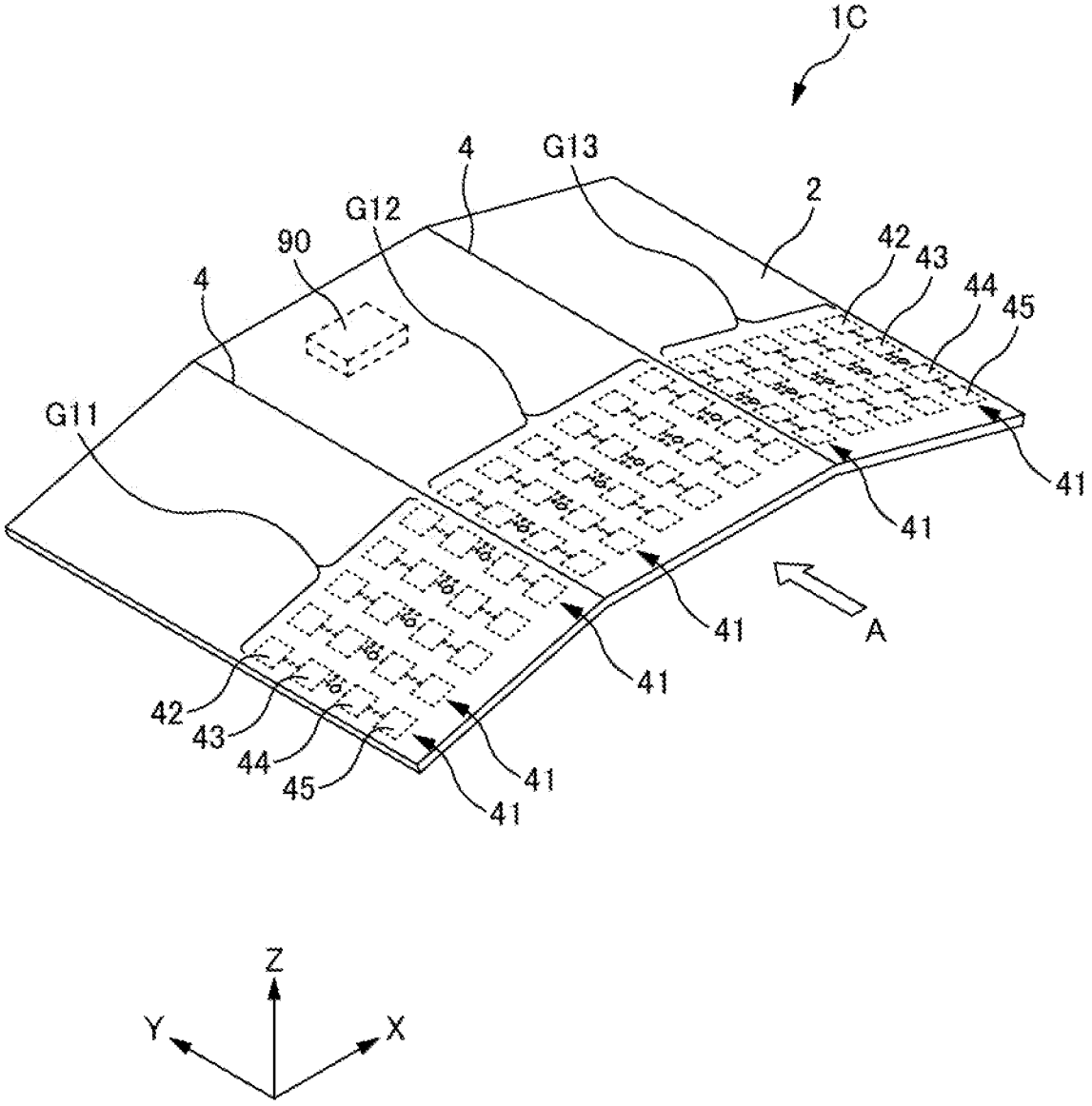
FIG. 31 is a perspective view of an antenna according to a modified example of a third embodiment.

FIG. 29 is a perspective view obtained with a bird's eye view of an antenna 1B according to a third embodiment. FIG. 30 is a front view of the antenna 1B when viewed in a direction of an arrow A illustrated in FIG. 29. FIG. 31 is a perspective view obtained with a bird's eye view of an antenna 1C according to a modified example of the third embodiment.

In the first embodiment, as illustrated in FIG. 1, the laminated body 2 is bent so as to be mountain-folded at one place, and the even-numbered element rows 41 are equally divided into two groups using one bending line 4. In contrast, in the third embodiment, as illustrated in FIGS. 29 and 30, a laminated body 2 is bent so as to be mountain-folded at two places, and even-numbered element rows 41 are divided into three groups G11, G12, and G13 using two bending lines 4. Hereinafter, the antenna 1B according to the third embodiment will be described in detail.

A bending angle at one of the bending lines 4 is equal to a bending angle at the other of the bending lines 4. The two groups G11 and G13 on both sides have an equal number of the element rows 41. In the example illustrated in FIG. 29, the number of the element rows 41 included in each of the groups G11 and G13 on both sides is six, and the number of the element rows 41 included in the group G12 at the center is four. As in the modified example illustrated in FIG. 31, the number of the element rows 41 included in each of the groups G11 and G13 on both sides may be five, and the number of the element rows 41 included in the group G12 at the center may be six. Note that, even when the total number of the element rows 41 is other than 16, the two groups G11 and G13 on both sides have an equal number of the element rows 41.

An RFIC 90 is surface-mounted on a center bending segment among three bending segments of the laminated body 2, in other words, a portion thereof between the two bending lines 4. Thus, a set of feed lines 21 can have symmetry with respect to a symmetry plane that is perpendicular to the center bending segment and extends through the center of the parallel arrangement of the element rows 41.

Herein, as illustrated in FIGS. 29 and 30, a corner formed between a radiation surface of the element rows 41 included in the group G11 on one side and a radiation surface of the element rows 41 included in the group G13 on the other side is an external corner, and it is assumed that the angle of the external corner is a. The angle α of the external corner is greater than 180°. Preferably, the angle α of the external corner is greater than 180° and is equal to or smaller than 270°. However, the angle α may be greater than 270° and smaller than 360°.

In FIG. 30, a bisector 3 of the external corner is parallel to the Z-axis. The bisector 3 is perpendicular to the radiation surface of the element row 41 included in the group G12 at the center. The direction of the bisector 3 is referred to as a reference direction, and an angle formed by being inclined from the reference direction to the X-axis is represented by θ. It is assumed that the angle θ is positive in a turn from the reference direction toward the positive direction of the X-axis, and is negative in a turn from the reference direction toward the negative direction of the X-axis. An angle β illustrated in FIG. 30 is an angle formed between a plane 5 orthogonal to the bisector 3 and the radiation surface of the element rows 41 included in the group G11. The angle β is also an angle formed between the plane 5 orthogonal to the bisector 3 and the radiation surface of the element rows 41 included in the group G13.

The RFIC 90 controls a phase of a signal wave of each of the feed lines 21, thereby controlling the directivity of the antenna 1B to achieve a wide angle. This is verified by simulation.

Figure 32:
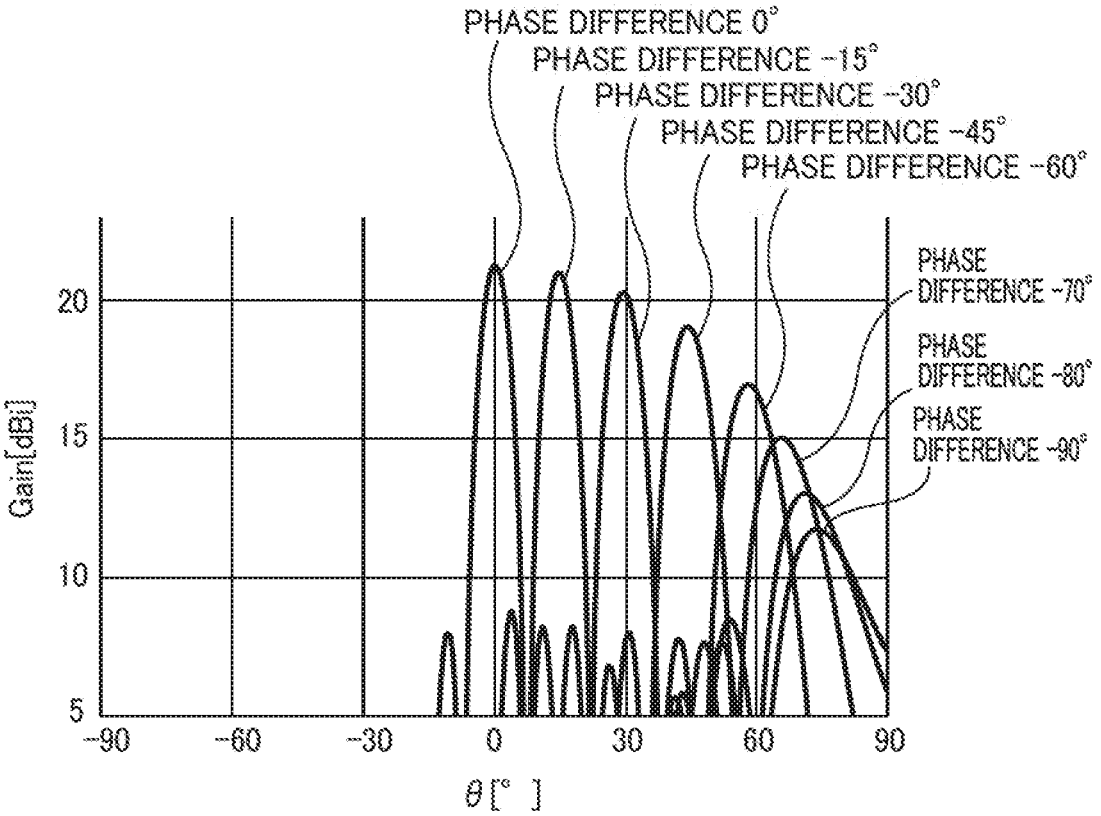
FIG. 32 is a graph illustrating a relationship between a gain and an angle when a phase of each element row of an antenna according to a third embodiment is controlled.
Figure 33:
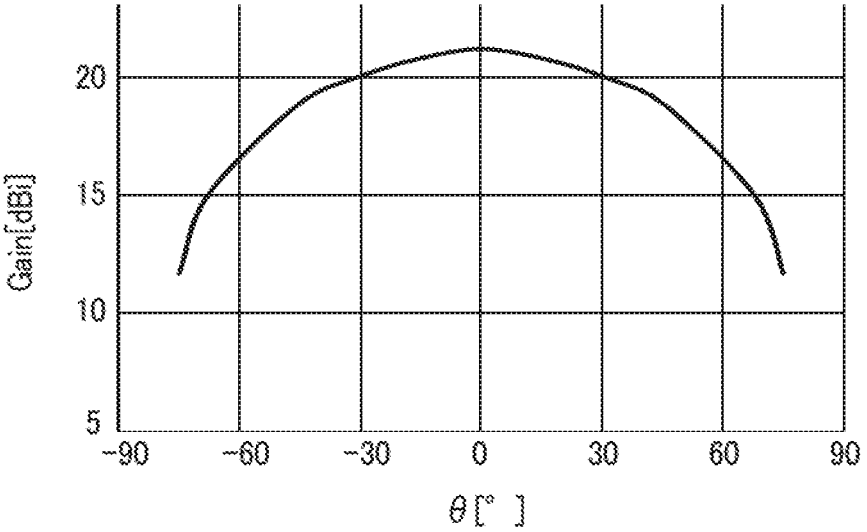
FIG. 33 is a graph illustrating a relationship between a peak of a gain and an angle when a phase of each element row of an antenna according to a third embodiment is controlled.

In a case where the angle β illustrated in FIG. 30 is 10°, and when a phase difference between signal waves of the feed lines 21 adjacent to each other of the antenna 1B illustrated in FIG. 29 is changed to −90°, −80°, −70°, −60°, −45°, −30°, −15°, and 0°, a relationship between a gain and the angle θ is illustrated in FIG. 32. FIG. 33 illustrates a curved line obtained by connecting the peaks of the gains illustrated in FIG. 32 with a line and complementing the line in a line symmetrical manner.

Figure 34:
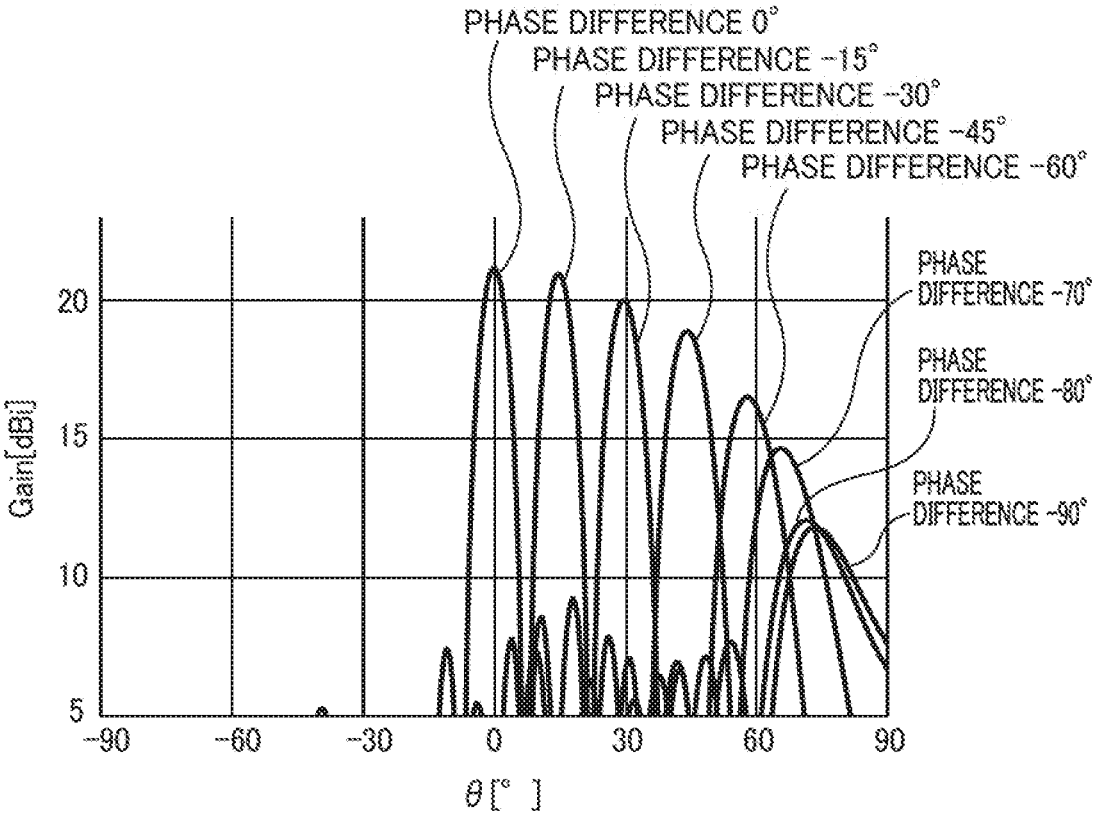
FIG. 34 is a graph illustrating a relationship between a gain and an angle when a phase of each element row of an antenna according to a modified example of a third embodiment is controlled.
Figure 35:
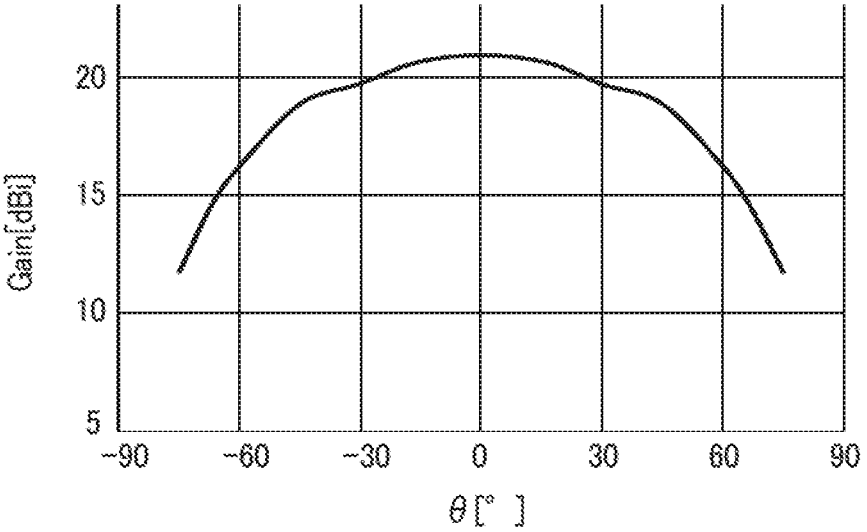
FIG. 35 is a graph illustrating a relationship between a peak of a gain and an angle when a phase of each element row of an antenna according to a modified example of a third embodiment is controlled.

In a case where the angle β illustrated in FIG. 30 is 10°, and when a phase difference between signal waves of the feed lines 21 adjacent to each other of the antenna 1C illustrated in FIG. 31 is changed to −90°, −80°, −70°, −60°, −45°, −30°, −15°, and 0°, a relationship between a gain and the angle θ is illustrated in FIG. 34. FIG. 35 illustrates a curved line obtained by connecting the peaks of the gains illustrated in FIG. 34 with a line and complementing the line in a line symmetrical manner.

In the case where the laminated body 2 is bent so as to be mountain-folded at two places, a range of the angle θ in which the peak of the gain is equal to or greater than 15 dBi is wider than a range of −60° to 60°, as illustrated in FIGS. 32, and 34. Accordingly, it is understood that, as compared to the case where the laminated body 2 is not bent (see FIG. 20), a range in which the directivity of the antennas 1B and 1C is controllable to be high has a wider angle in the case where the laminated body 2 is bent so as to be mountain-folded at two places.

The directivity of the antenna 1B in the direction of the negative angle θ and the directivity of the antenna 1B in the direction of the positive angle θ are substantially the same. Particularly, the distribution (see FIG. 33 or 35) of the peaks of the gains of the antennas 1B and 1C by phase control has higher symmetry than the distribution (see FIG. 6) of the peaks of the gains of the antenna 1 by phase control. This is because the set of the feed lines 21 has symmetry, with the RFIC 90 being surface-mounted on the center bending segment as illustrated in FIGS. 29 and 31.

REFERENCE SIGNS LIST

1, 1A, 1B, 1C: Antenna;
2: Laminated body;
11: First dielectric layer;
12: Second dielectric layer;
13: Third dielectric layer;
20: Conductive pattern layer;
21: Feed line;
30: Conductive ground layer;
40: Antenna pattern layer;
41: Element row;
42, 43, 44, 45: Radiation element;
G1, G2, G11, G12, G13: Group.

The invention claimed is:

1. An antenna comprising:

a laminated body having a sheet shape, the laminated body including a first dielectric layer that is flexible, a conductive pattern layer formed on a surface of the first dielectric layer, a second dielectric layer that is flexible, the second dielectric layer being bonded to the first dielectric layer on a side opposite to the conductive pattern layer with respect to the first dielectric layer, a conductive ground layer formed between the first dielectric layer and the second dielectric layer, and an antenna pattern layer formed on the second dielectric layer on a side opposite to the conductive ground layer with respect to the second dielectric layer, the antenna pattern layer including a plurality of element rows arranged in parallel, the element rows each including even-numbered radiation elements that are linearly aligned at an interval in a direction orthogonal to a direction in which the element rows arranged in parallel, the even-numbered radiation elements being connected in series, the conductive pattern layer including a plurality of feed lines each for feeding power to the center of each of the element rows, the laminated body being bended along a bending line parallel to an alignment direction of the even-numbered radiation elements, thereby dividing the element rows into a plurality of groups using the bending line as a boundary, wherein the bending line includes two bending lines, the element rows are divided into three groups using the bending lines as boundaries, and groups on both sides among the three groups have an equal number of the element rows, and an RFIC is mounted on a portion of the laminated body between the two bending lines.

2. The antenna according to claim 1, wherein the laminated body is bent so as to be mountain-folded along the bending line with the antenna pattern layer facing outward.

3. The antenna according to claim 1, wherein a bending angle of the laminated body at one of the bending lines is equal to a bending angle of the laminated body at another one of the bending lines.

4. An antenna comprising:

a laminated body having a sheet shape, the laminated body including a first dielectric layer that is flexible, a conductive pattern layer formed on a surface of the first dielectric layer, a second dielectric layer that is flexible, the second dielectric layer being bonded to the first dielectric layer on a side opposite to the conductive pattern layer with respect to the first dielectric layer, a conductive ground layer formed between the first dielectric layer and the second dielectric layer, and an antenna pattern layer formed on the second dielectric layer on a side opposite to the conductive ground layer with respect to the second dielectric layer, the antenna pattern layer including a plurality of element rows arranged in parallel, the element rows each including even-numbered radiation elements that are linearly aligned at an interval in a direction orthogonal to a direction in which the element rows arranged in parallel, the even-numbered radiation elements being connected in series, the conductive pattern layer including a plurality of feed lines each for feeding power to the center of each of the element rows, the laminated body being bended along a bending line parallel to an alignment direction of the even-numbered radiation elements, thereby dividing the element rows into a plurality of groups using the bending line as a boundary, wherein the bending line includes two bending lines, the element rows are divided into three groups using the bending lines as boundaries, groups on both sides among the three groups have an equal number of the element rows, and the groups on both sides among the three groups have a different number of the element rows from the group in between the bending lines.

5. The antenna according to claim 4, wherein the laminated body is bent so as to be mountain-folded along the bending line with the antenna pattern layer facing outward.

6. The antenna according to claim 4, wherein the laminated body is bent so as to be valley-folded along the bending line with the antenna pattern layer facing inward.

7. The antenna according to claim 4, wherein a bending angle of the laminated body at one of the bending lines is equal to a bending angle of the laminated body at another one of the bending lines.

8. The antenna according to claim 4, wherein an RFIC is mounted on a portion of the laminated body between the two bending lines.

9. An antenna comprising:

a laminated body having a sheet shape, the laminated body including a first dielectric layer that is flexible, a conductive pattern layer formed on a surface of the first dielectric layer, a second dielectric layer that is flexible, the second dielectric layer being bonded to the first dielectric layer on a side opposite to the conductive pattern layer with respect to the first dielectric layer, a conductive ground layer formed between the first dielectric layer and the second dielectric layer, and an antenna pattern layer formed on the second dielectric layer on a side opposite to the conductive ground layer with respect to the second dielectric layer, the antenna pattern layer including a plurality of element rows arranged in parallel, the element rows each including even-numbered radiation elements that are linearly aligned at an interval in a direction orthogonal to a direction in which the element rows arranged in parallel, the even-numbered radiation elements being connected in series, the conductive pattern layer including a plurality of feed lines each for feeding power to the center of each of the element rows, the laminated body being bended along a bending line parallel to an alignment direction of the even-numbered radiation elements, thereby dividing the element rows into a plurality of groups using the bending line as a boundary, wherein the bending line includes two bending lines, the element rows are divided into three groups using the bending lines as boundaries, and groups on both sides among the three groups have an equal number of the element rows, and an RFIC is mounted on only a portion of the laminated body between the two bending lines.

10. The antenna according to claim 9, wherein the laminated body is bent so as to be mountain-folded along the bending line with the antenna pattern layer facing outward.

11. The antenna according to claim 9, wherein the laminated body is bent so as to be valley-folded along the bending line with the antenna pattern layer facing inward.

12. The antenna according to claim 9, wherein a bending angle of the laminated body at one of the bending lines is equal to a bending angle of the laminated body at another one of the bending lines.

* * * * *